US005524994A

United States Patent [19]

Hirano et al.

[11] Patent Number: 5,524,994

[45] Date of Patent: Jun. 11, 1996

[54] PAPER SKEW REMOVAL APPARATUS AND A PRINTER USING THE SAME

[75] Inventors: Seiichi Hirano; Kenjiro Murakami; Hiroshi Ishida; Kenichi Miyazaki; Satoshi Fujioka, all of Suwa, Japan

[73] Assignee: Seiko Epson Corporation, Tokyo, Japan

[21] Appl. No.: 133,717

[22] Filed: Oct. 7, 1993

Related U.S. Application Data

[63] Continuation-in-part of Ser. No. 119,012, Sep. 9, 1993.

[30] Foreign Application Priority Data

Oct. 8, 1992 [JP] Japan ..... 4-270565
Nov. 6, 1992 [JP] Japan ..... 4-322765

[51] Int. Cl.[6] ..... B41J 11/42

[52] U.S. Cl. ..... 400/579; 400/630; 400/315; 271/245

[58] Field of Search ..... 101/181, 183, 101/228; 271/226, 227, 241, 245; 400/579, 630, 568, 569, 313, 314, 314.1, 314.6, 315, 319, 320.1, 321

[56] References Cited

U.S. PATENT DOCUMENTS 5,000,594 3/1991 Beehler et al. ..... 400/314
5,072,925 12/1991 Thiel ..... 271/227
5,083,879 1/1992 Sato et al. ..... 400/579

FOREIGN PATENT DOCUMENTS 0100675 2/1984 European Pat. Off. .
0464785 1/1992 European Pat. Off. .
0487923 6/1992 European Pat. Off. .
0509667 10/1992 European Pat. Off. .
3007364 1/1991 Japan ..... 400/579
2208852 4/1989 United Kingdom .
2215315 9/1989 United Kingdom .

*Primary Examiner*—Ren Yan
*Attorney, Agent, or Firm*—Stroock & Stroock & Lavan

[57] ABSTRACT

A paper skew removal apparatus including a single paper feed roller for feeding a paper in a state that the paper feed roller is in contact with the central part of the paper as viewed in the paper width direction, and a paper feed roller and gate roller for contacting the leading edge of the paper, the portions of the rollers that contact the leading edge of the paper are disposed in a direction orthogonal to the advancing direction of the paper fed by the paper feed roller. A printer is also disclosed which incorporates the disclosed paper skew removal apparatus. The inventive and unique construction provides reduction of paper feed time and size reduction in the overall printer, as well as ensuring a reliable skew removal from the paper.

18 Claims, 21 Drawing Sheets

242
243
271
277
272
276
274
275
280
273
281
225
226
278
279
260

242
243
271
277
272
273
276
274
275
279
260
278

PAPER SKEW REMOVAL APPARATUS AND A PRINTER USING THE SAME

This is a continuation-in-part of application Ser. No. 08/119,012, filed on Sep. 9, 1993.

BACKGROUND OF THE INVENTION

The present invention relates generally to a paper skew removal apparatus for use in a paper feeder, and, in particular, to a paper skew removal apparatus for use in a printer that will reduce the printer size and speed up print time, and a technique for removing the skew of paper in a paper feeder.

Generally, various types of paper skew removal apparatuses have been proposed. FIGS. 20(*a*)–20(*c*) illustrate a paper skew removal apparatus described in Unexamined Japanese Patent Application No. Hei. 1-141070. The paper skew removal apparatus includes a platen 2 positioned orthogonal to an advancing direction A of a paper P fed by paired paper feed rollers 1, 1. The axis of platen 2 is parallel to the axis of each of the paired paper feed rollers 1, 1. When leading edge Pa of paper P advances and contacts platen 2, a slack loop Pb forms in paper P as shown in FIG. 20(*b*). The slack loop Pb absorbs a skew of the paper. Thereafter, platen 2 rotates in a clockwise direction so as to feed paper P as shown in FIG. 20(*c*). With platen 2 rotating in the clockwise direction, and paper P moving in the direction as indicated by arrow A, paired paper feed rollers 1, 1 rotate in the clockwise direction and a slackened part Pb', having absorbed the skew, gradually disappears.

Another paper skew removal apparatus, shown in FIGS. 21(*a*)–21(*c*), is described in Unexamined Japanese Patent Publication No. Hei. 2-62348. FIG. 21(*a*) shows a single long paper feed roller 3 and a discharge film 4 which interact with each other to feed paper P while pressing the paper over its full width. A pair of rollers 5, 6, positioned downstream of the combination of paper feed roller 3 and discharge film 4, are arrayed orthogonal to the advancing direction A of paper P. A leading edge Pa of paper P moves in the direction as indicated by arrow A and contacts a nip T between stationary paired rollers 5, 6. Then, as shown in FIG. 21(*b*), paper P is turned in the direction of an arrow B. As a result, the paper skew is removed and the paper is orientated as shown in FIG. 21(*c*).

The conventional paper skew removal apparatuses employing the structures described above have the following problems.

In the paper skew removal apparatus of FIG. 20, a slack loop Pb of paper P must be formed between paired paper feed roller 1, 1 and platen 2. Accordingly, a large space must be provided between paired paper feed roller 1, 1 and platen 2, and there is a long delay before paper P reaches platen 2. Formation of slack loop Pb after the paper reaches platen 2 also delays printing.

Thus, the paper skew removal apparatus of FIG. 20 has too long a paper feed time. Further, the size of the paper skew removal apparatus is large since paired paper feed roller 1, 1 and platen 2 must be positioned sufficiently away from each other in order to form the slack loop.

Furthermore, the paper skew removal apparatus described in FIG. 21 is constructed and arranged so that discharge film 4 cooperates with single long paper feed roller 3 to press the paper over its full width. Therefore, the paper skew removal apparatus has difficulty rotating paper P to remove the skew because of the pressure upon paper P over its full width.

Accordingly, it is desired to provide an improved paper skew removal apparatus which has a reduced paper feed time, a reduced size, and is capable of reliably removing a skew from the skewed paper.

SUMMARY OF THE INVENTION

Generally speaking, in accordance with the invention, a paper skew removal apparatus includes a single paper feed roller for feeding a sheet of paper, the paper feed roller having a width less than the width of the paper, and the paper feed roller being in contact with the central part of the paper as viewed in the paper width direction. The apparatus also includes contact means for contacting a leading edge of the paper, the contact means disposed in a direction orthogonal to the advancing direction of the paper fed by said paper feed roller. Furthermore, in the paper skew removal apparatus, a paper guide for forcing the paper into a curved shape, guiding the paper to the contact means and for supporting the convex side of the paper, is preferably located between the paper feed roller and the contact means.

In accordance with another aspect of the present invention, there is provided a printer including a single paper feed roller for feeding a sheet of paper, the paper feed roller having a width less than the width of the paper, and the paper feed roller being in contact with the central part of the paper as viewed in the paper width direction. Furthermore, the printer includes contact means for contacting a leading edge of the paper, the contact means being disposed in a direction orthogonal to the advancing direction of the paper fed by the paper feed roller. The contact means also includes a contact portion located between a second paper feed roller and a gate roller. The gate roller is engageable with the second paper feed roller. In the printer, the second paper feed roller may be a paper feed roller of an automatic paper feeder assembled into the printer. When the single paper feed roller rotates, the second paper feed roller and the gate roller may rotate in the opposite direction to the rotation direction of the paper feed roller so that paper cannot be fed between said second paper feed roller and said guide roller, or the second paper feed roller and the gate roller may be essentially motionless.

Accordingly, an object of the present invention is to provide an improved paper skew removal apparatus.

Another object of the present invention is to provide an improved paper skew removal apparatus that will not damage the paper when any skew is removed.

Still another object of the present invention is to provide a printer having a reduction in paper feed time.

A still further object of the present invention is to provide a printer incorporating the improved paper skew removal apparatus.

A further object of the present invention is to provide a printer that is reduced in overall size.

An additional object of the present invention is to provide an improved paper guide to help ensure a smooth reliable paper rotation and skew removal.

Still another object of the present invention is to provide a printer having a paper skew removal apparatus in which the paper is transported immediately to the printhead after the skew of the paper is removed.

Still other objects and advantages of the invention will in part be obvious and will in part be apparent from the specification.

The invention accordingly comprises the features of construction, combination of elements and arrangement of parts which will be exemplified in the constructions hereinafter set forth, and the scope of the invention will be indicated in the claims.

BRIEF DESCRIPTION OF THE DRAWINGS

For a fuller understanding of the invention, reference is had to the following description, taken in connection with the accompanying drawings, in which:

FIG. 2(*b*) is a rear view of the printer of FIG. 2(*a*);

BRIEF DESCRIPTION OF THE PREFERRED EMBODIMENT

Figure 1A:
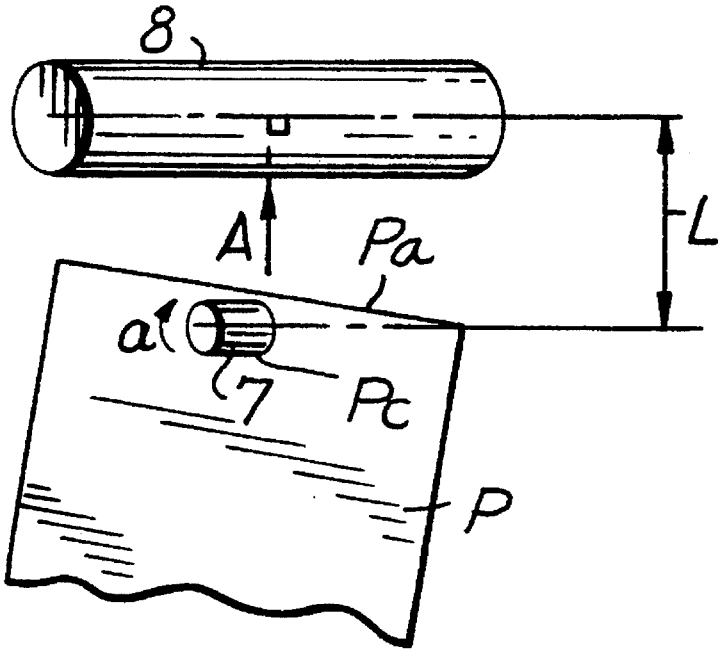
FIGS. 1(*a*) and 1(*b*) are diagrammatic views showing the construction and the operation of a paper skew removal apparatus in accordance with the present invention.
Figure 1B:
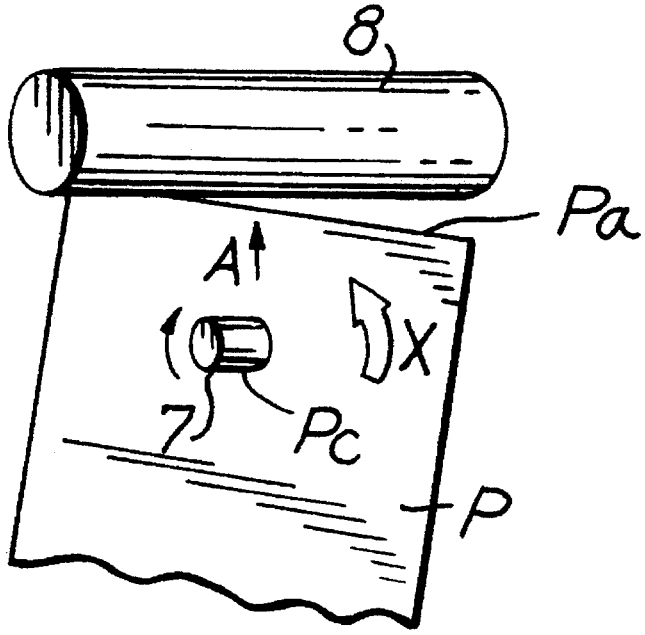

Reference is first made to FIG. 1(*a*) of the drawings which depicts a paper feed roller 7 formed of a single short roller. Feed roller 7 presses upon only a central portion Pc of a paper P as viewed in the paper width direction and rotates in the direction of an arrow a to feed paper P.

In this first embodiment a contact portion 8 is in the form of a roller. Contact portion 8 is positioned to receive the leading edge Pa of the paper P. When the leading edge Pa of the advancing paper P contacts contact portion 8, leading edge Pa may not be orthogonal to the axis of contact portion 8. Therefore, a realignment operation must occur in order to place leading edge Pa and, therefore, paper P orthogonal to the axis of contact portion 8. This reorientation is performed by further advancing paper P until leading edge Pa contacts contact portion 8. Essentially simultaneously, paper P will rotate in the direction of an arrow X of FIG. 1(*b*). With the orientation of contact portion 8 perpendicular to the axis of contact portion 8, any paper skew is removed and paper P can advance correctly.

The resultant skew removal operation is reliable and operates well because feed roller 7 is a single short roller and presses only upon central part Pc of the paper as viewed in the width direction. Therefore, the paper will rotate easier about central part Pc by the operation of feed roller 7 than it would rotate in conventional skew removal apparatuses.

Experimentation has found that for best results, the width of the feed roller should be essentially equal to or less than one-third (⅓) the width of the paper being fed through the printer. In a preferred embodiment, the width of feed roller 7 is about 17 to 20 mm. The width of the preferred embodiment of feed roller 7 is about 10% of the width of a sheet of A4 paper, which is approximately 210 mm. wide.

The paper skew removal apparatus constructed and arranged in accordance with the first embodiment of the invention has the following advantages.

First, there is no need to form a slack loop between feed roller 7 and contact portion 8. Accordingly, a distance L (FIG. 1(*a*)) between feed roller 7 and contact portion 8 may be reduced, and no space to account for slack loop Pb of the paper is required.

Second, because of the close positions between feed roller 7 and contact portion 8, the feed time is reduced.

Lastly, the close proximity between feed roller 7 and contact portion 8 will realize an overall reduction of the paper skew removal apparatus.

It is also to be understood that contact portion 8 need not be a roller as depicted in FIGS. 1(*a*) and 1(*b*), but may be formed of a plate-like member. Moreover, it is possible that any other type of contact portion may be utilized if it is orientated at a right angle to the advancing direction of the paper fed by the feed roller and is capable of contacting the leading edge of the advancing paper in order to help rotate paper P for proper feeding into the print area.

A printer incorporating the paper skew removal apparatus constructed and arranged in accordance with the first embodiment will now be described.

Figure 2A:
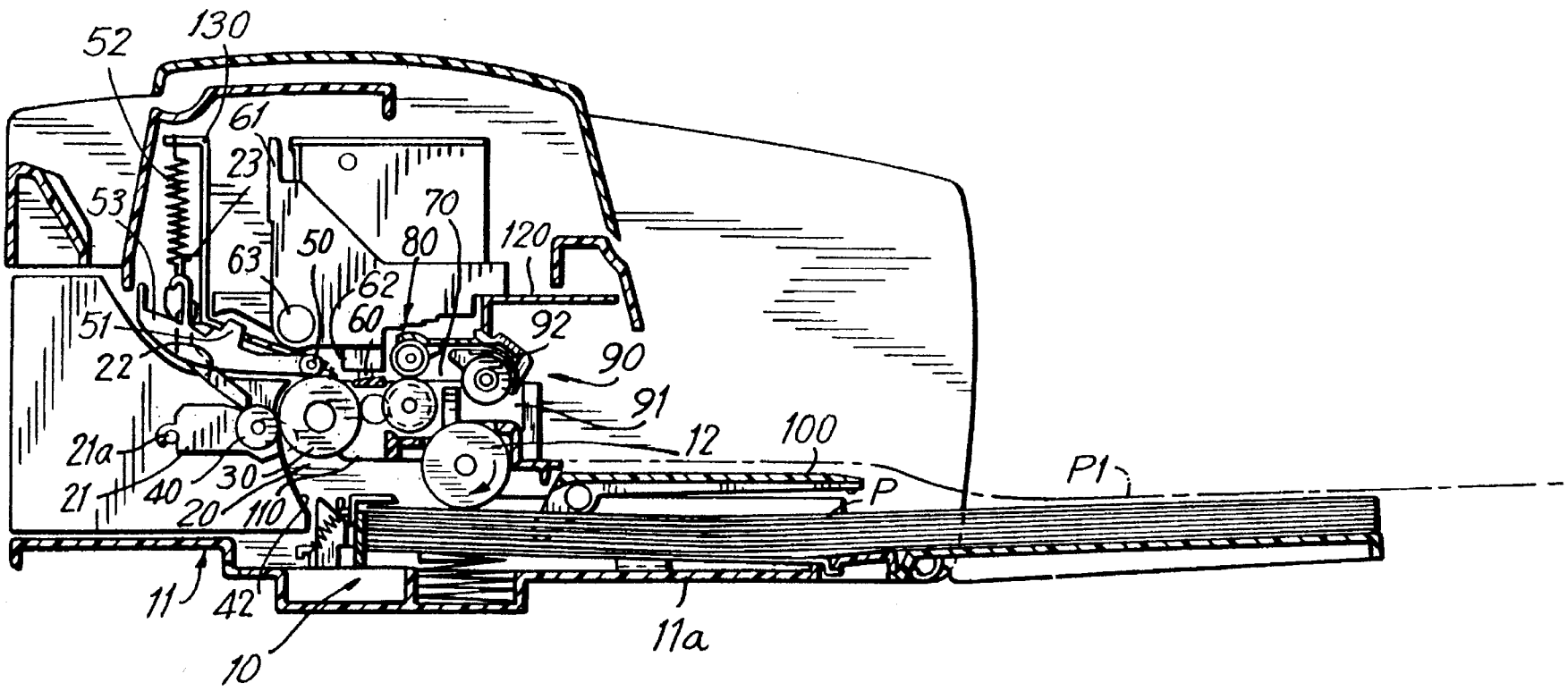
FIG. 2(*a*) is a cross-sectional view showing a printer incorporating a paper skew removal apparatus in accordance with a first embodiment of the present invention.
Figure 2B:
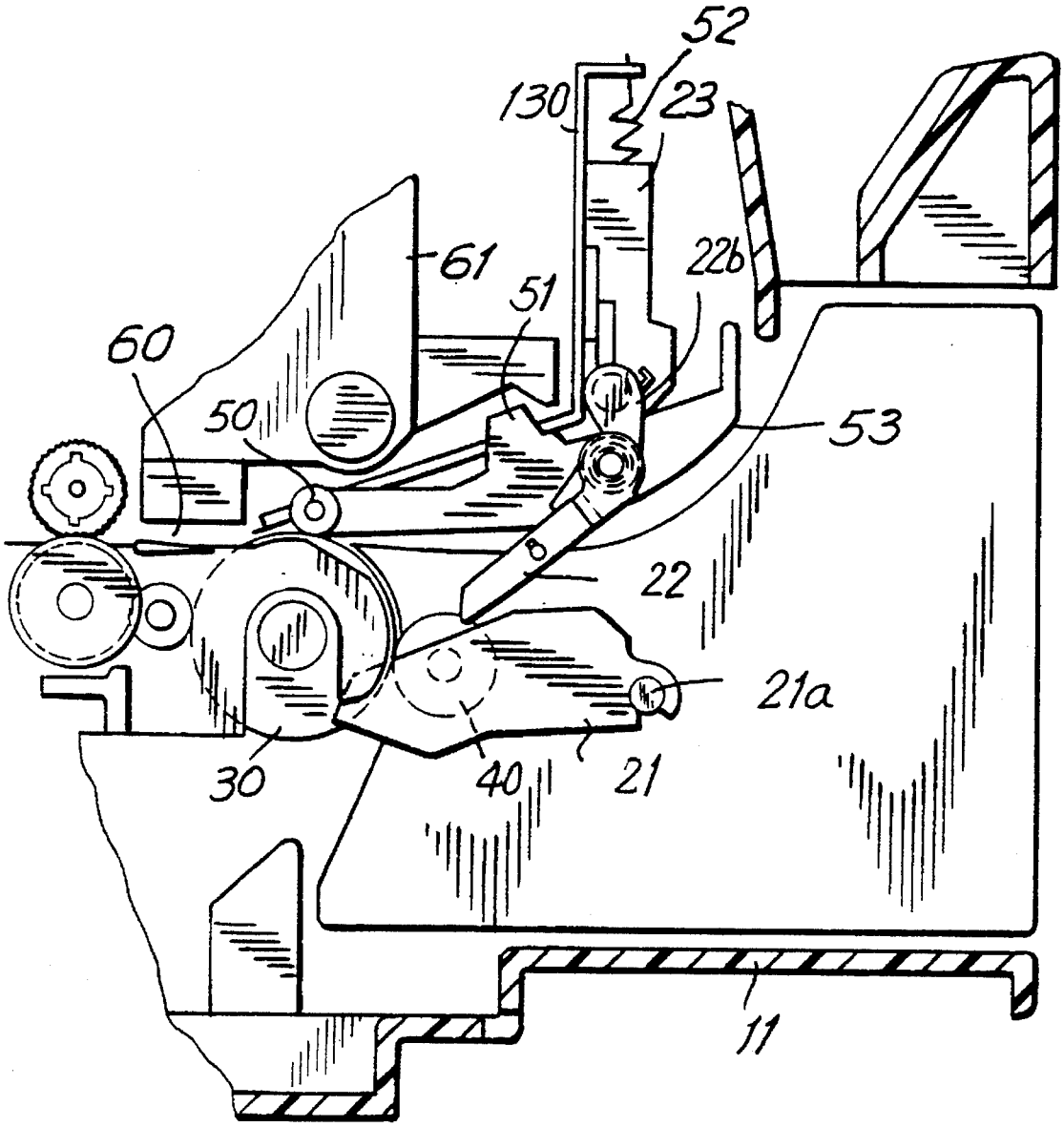

FIGS. 2(*a*) and 2(*b*) illustrate an automatic feed device generally indicated at 10. In automatic feed device 10, there is a stacker section with the bottom of the stacker section being formed of a bottom 11*a* of a lower case 11 of the printer.

Sheets of paper P are fed individually by a paper feed roller 12 into an automatic paper feed path 20. Automatic feed device 10 includes a first lever 21 for detecting when a sheet of paper is fed to automatic paper feed path 20.

As viewed in FIGS. 2(*a*) and 2(*b*), when paper P is fed into automatic paper feed path 20, first lever 21 rotates in a counterclockwise direction about pin 21*a*. Upon the rotation of first lever 21, a second lever 22 will also rotate in a counterclockwise direction. Further, a third lever 22(*b*) will also rotate in a counterclockwise direction. After the rotation of these three levers, a paper detect switch 23 detects the paper that has been fed into automatic feed path 20.

Once the paper is detected by paper detect switch 23, any paper skew existing in paper P is removed by a skew removal process which will be described below. Thereafter, paper P is wound around paper feed rollers 30 and moves along automatic paper feed path 20 to reach a print section 60. Prior to reaching print section 60, paper P advances by way of pinch rollers 50, which are similar in operation to paper feed rollers 30 and remain in contact therewith.

Pinch rollers 50 are rotatably attached to a distal end of a paper guide 53 suspended from a left side frame 130 by means of a spring 52 so that paper guide 53 rotates about a fulcrum 51.

Print section 60 is located between the upper surface of an intermediate frame 110 and an ink jet head 62 mounted on a carriage 61. Carriage 61 is coordinately displaceable in a direction normal to the plane of FIG. 2. Carriage 61 is guided at one end thereof by a guide shaft 63 and at the other end thereof by an upper frame 120.

Figure 3:
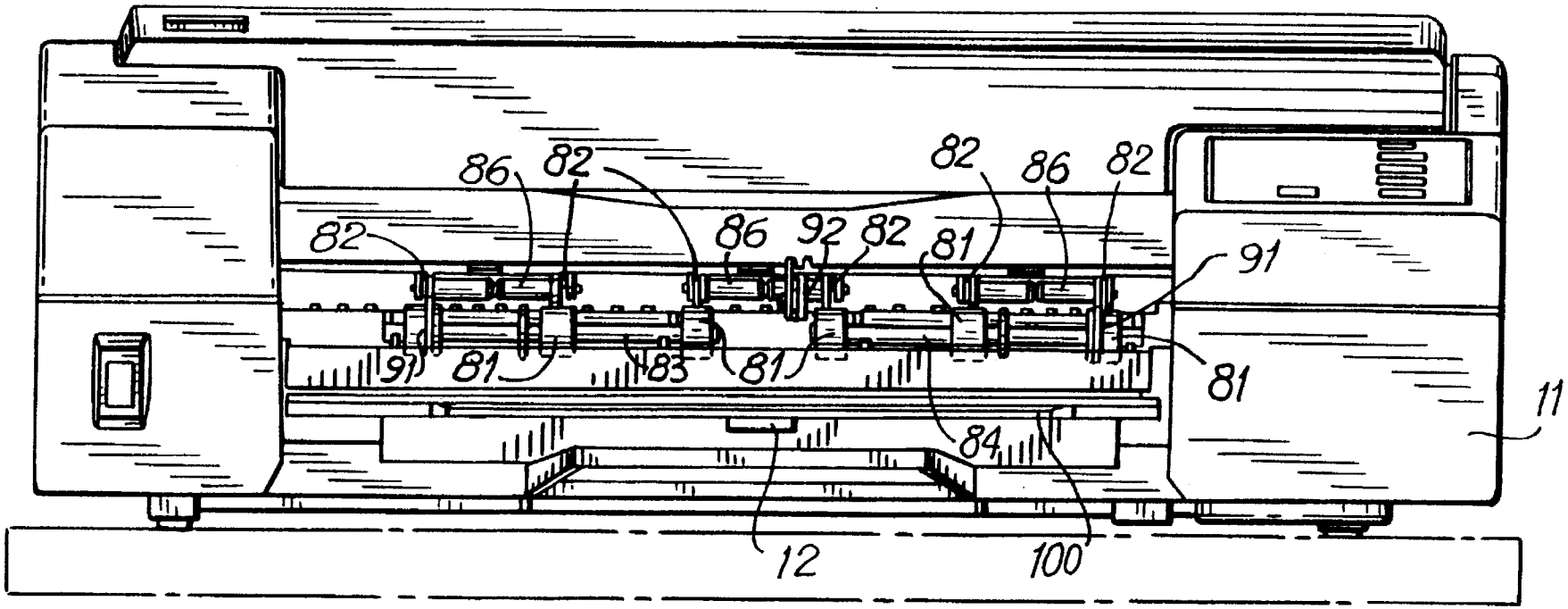
FIG. 3 is a front elevational view of a first embodiment of a printer in accordance with the present invention.

After the paper has passed through print section 60 and has had ink disposed thereon, the paper enters a paper exit path 70. Paper exit path 70 includes a transport section, generally indicated at 80, located in paper exit path 70. While paper P passes through transport section 80, paper P passes over transport rollers 81 (FIG. 3) and notched transport rollers 82 (FIG. 3). Paper P then enters an exit section, generally indicated at 90, for discharging the paper while holding the paper in a concaved state as seen in the paper discharging direction. Exit section 90 includes a push-up portion 91 located on both sides of exit portion 90. Push up portion 91 pushes up the paper at both sides thereof while a notched roller 92 pushes down the central portion of the paper. The paper is thereafter discharged onto a discharged paper tray 100 while in the concaved state.

A detailed description will now be given to a paper skew removal apparatus constructed and arranged in accordance with a first embodiment of the present invention.

Figure 4:
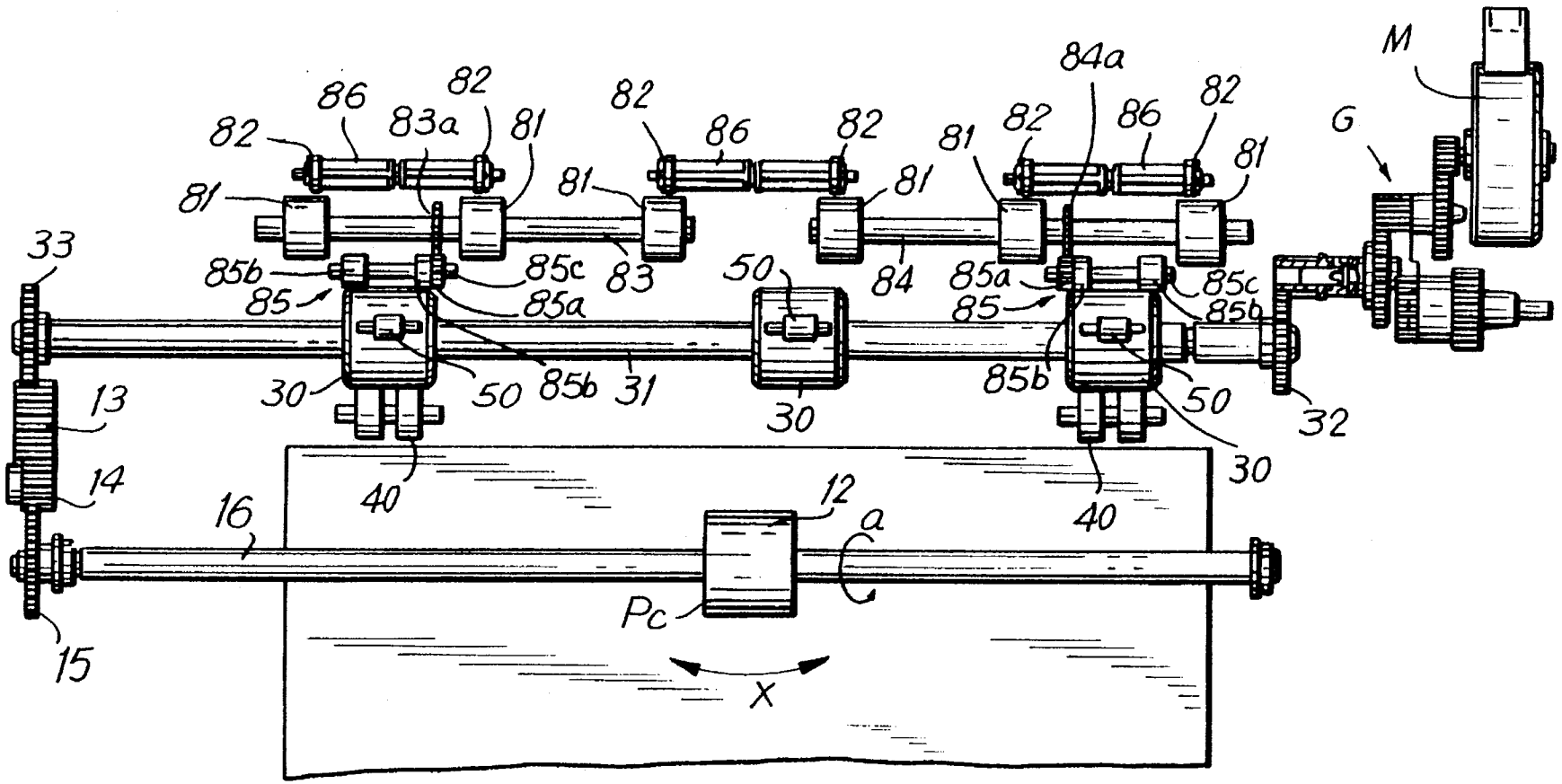
FIG. 4 is a developed plan view showing a drive mechanism of the printer of FIG. 2.
Figure 5:
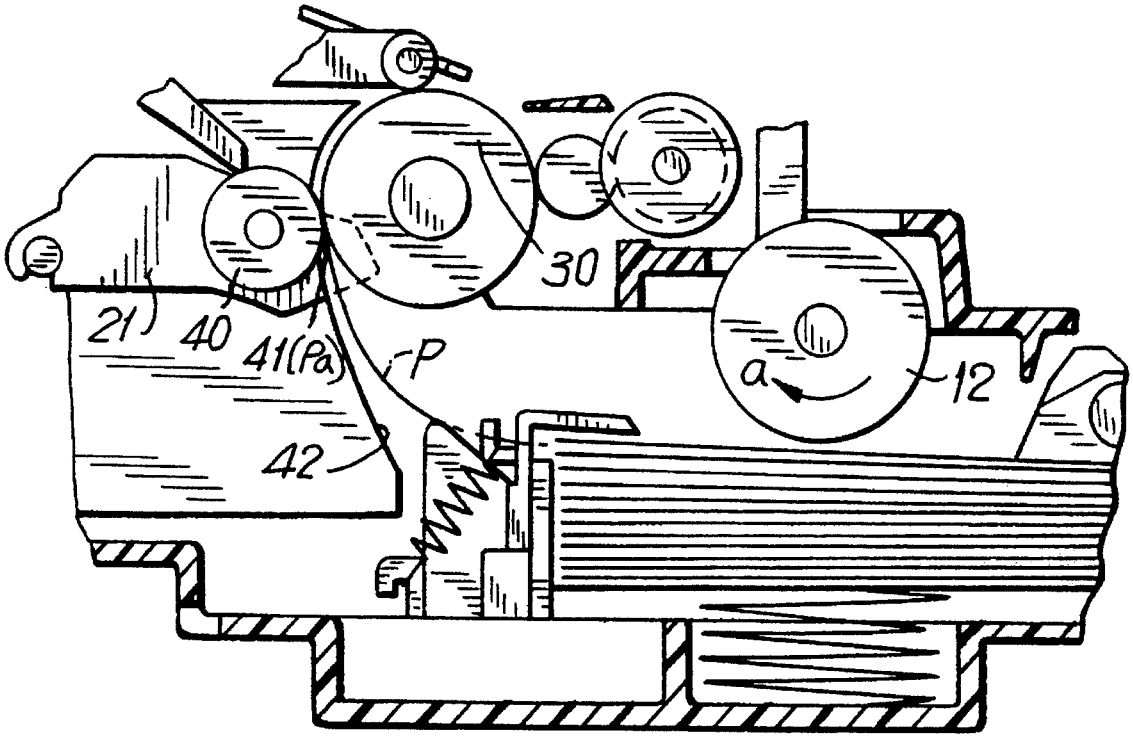
FIG. 5 is an enlarged fragmentary cross-sectional view of the left side of the printer of FIG. 2.

As illustrated in FIGS. 4 and 5, a paper skew removal apparatus includes paper feed roller 12, a contact portion 41 located between paper feed rollers 30 and gate rollers 40 and a paper guide 42. Paper guide 42 guides paper P (indicated by a phantom line in FIG. 5) which has been fed by paper feed roller 12 to contact portion 41, located between paper feed rollers 30 and gate rollers 40. Here, paper P is forced into a curved shape and paper guide 42 supports the convex side of the curved portion of the paper.

FIG. 4 is a developed plan view illustrating a drive mechanism including many of the rollers depicted in the printer of FIG. 2. Positional relationships of the rollers and the like do not necessarily coincide with those respective components in other drawings.

Paper feed roller 12 is rotatably driven by a paper feed motor M. Similar to feed roller 7 depicted in FIGS. 1(*a*) and 1(*b*), feed roller 12 is about 17 to 20 mm. wide. The width of feed roller 12, like that of feed roller 7, has been found by experimentation to operate best when it is essentially equal to or less than one-third (⅓) the width of the paper fed in the printer and typically about 10% the width of the width of A4 paper. Motor M drives a gear G which, in turn, drives a gear 32 fastened to one end of a feed roller shaft 31. At the other end of feed roller shaft 31 is a gear 33. Gear 33 engages sun gear 13 which, in turn, engages planetary gear 14. Planetary gear 14 engages with and disengages from feed gear 15. Planetary gear 14 engages feed gear 15 only when the carriage reaches a paper feed position. Feed gear 15 is secured to one end of feed roller shaft 16. Accordingly, because paper feed roller 12 is secured to feed roller shaft 16, the rotation of feed motor M causes the rotation of paper feed roller 12. Further, when paper feed roller 12 rotates in the paper feed direction as indicated by arrow a, paper feed rollers 30 will rotate in the opposite direction as that of paper feed roller 12 (i.e., in a direction opposite to that of the paper feed direction).

Furthermore, mounted on and affixed to feed roller shaft 31 are three paper feed rollers 30. Feed roller shaft 31 directly drives paper feed rollers 30. Gate rollers 40 are forced against and contact paper feed rollers 30 by means of an urging member (not shown) and any rotation of paper feed rollers 30 is directly transmitted to gate rollers 40.

Figure 6:
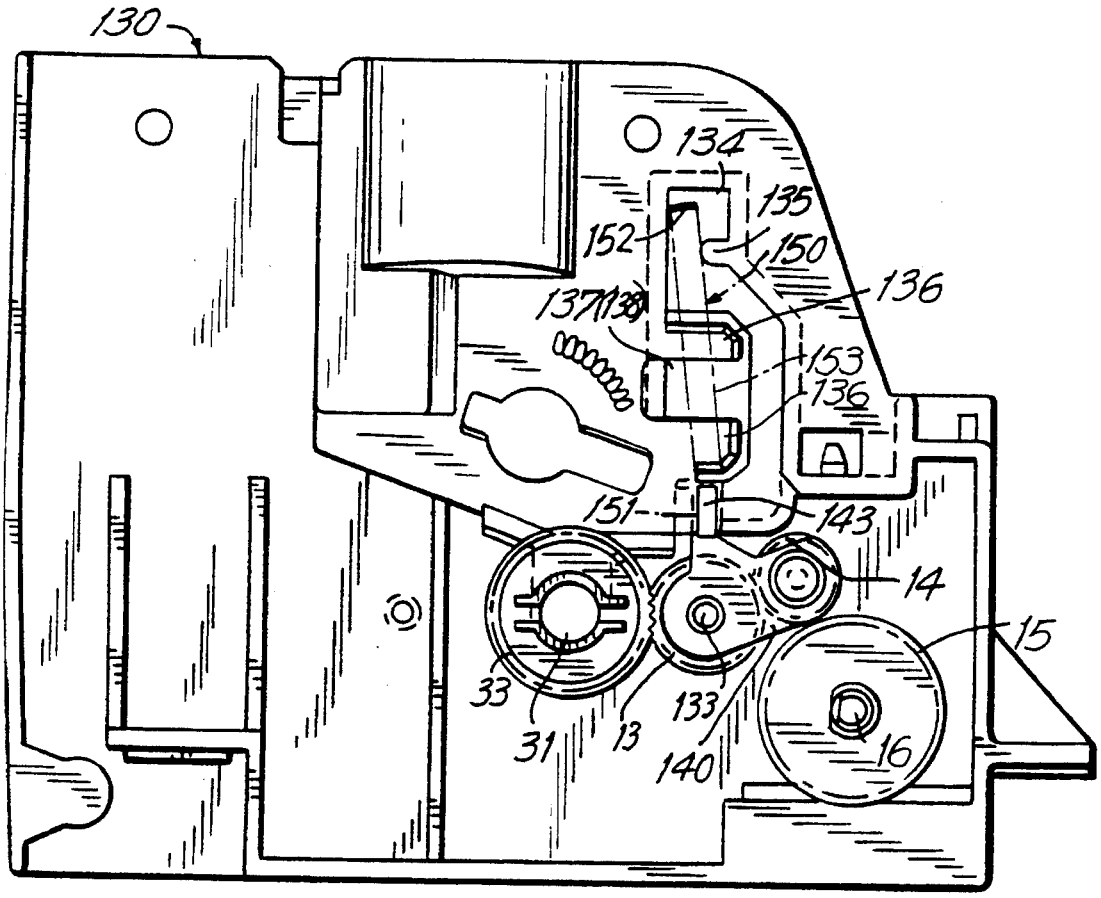
FIG. 6 is an enlarged side elevational view of a left side frame portion of the printer of FIG. 2 and certain components mounted thereon.

FIG. 6 is an enlarged side view depicting a left side frame portion, generally indicated at 130, of the printer case. Left side frame 130 supports the left end portions of feed roller shaft 31 and feed roller shaft 16. An arm 140, located outside sun gear 13, is rotatably supported by shaft 133.

Figure 7:
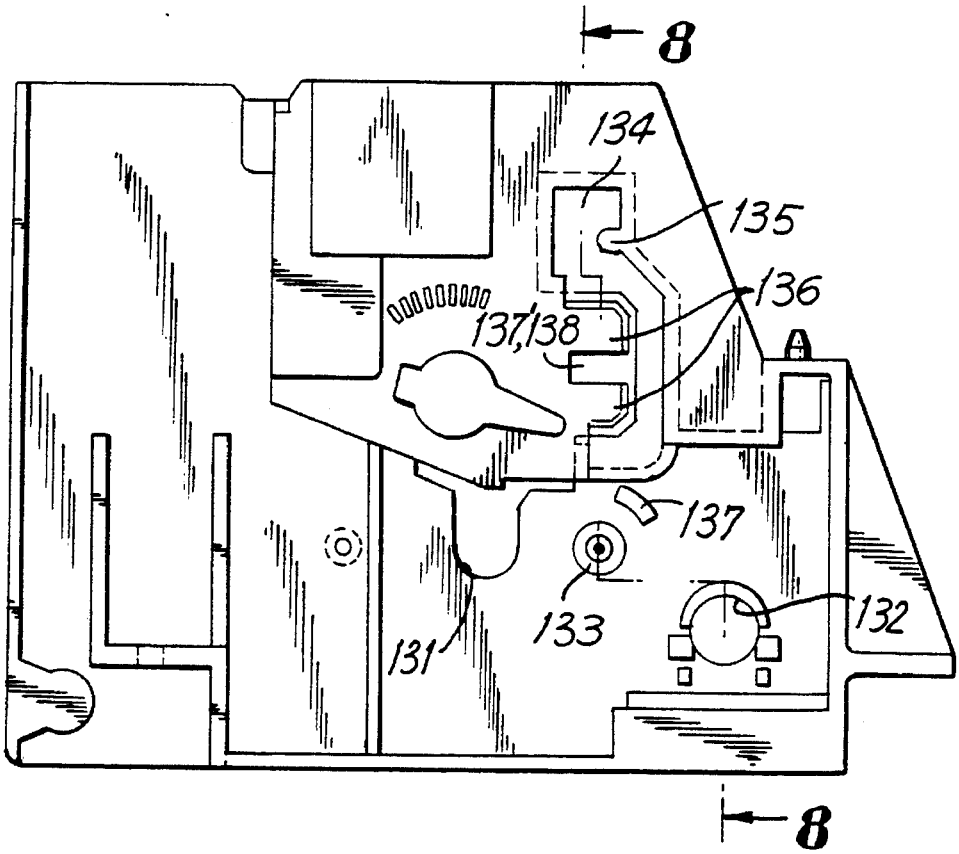
FIG. 7 is a detailed side elevational view of the left side frame portion of FIG. 6.
Figure 8:
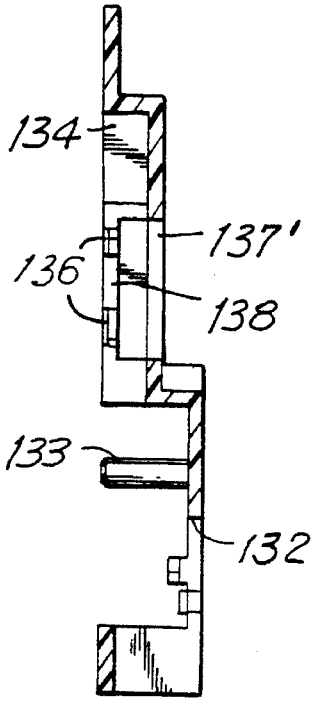
FIG. 8 is a cross-sectional view taken along lines 8—8 of FIG. 7.
Figure 9E:
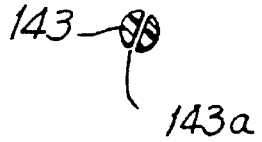
FIG. 9*e* is a cross-sectional view taken along lines 9*e*—9*e* of FIG. 9*a;*
Figure 9D:
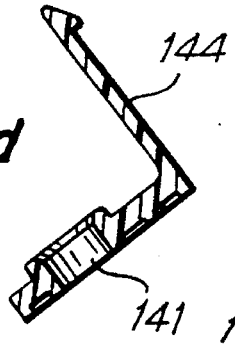
FIG. 9*d* is a cross-sectional view taken along lines 9*d*—9*d* of FIG. 9*a;*
Figure 9A:
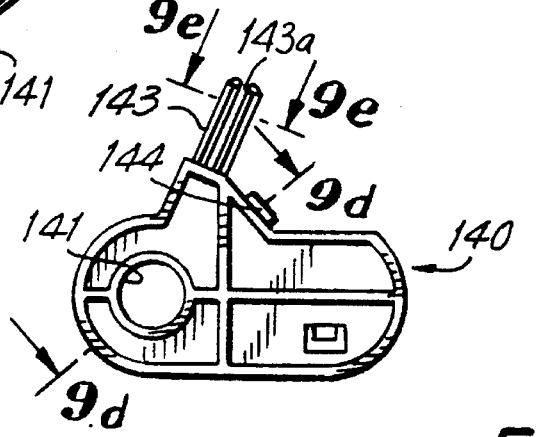
FIG. 9*a* is a left side view of an arm used in the printer in accordance with the invention.
Figure 9G:
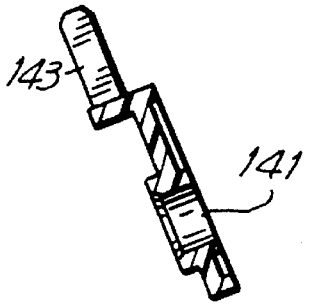
FIG. 9*g* is a cross-sectional view taken along line 9*g*—9*g* of FIG. 9*b;*
Figure 9B:
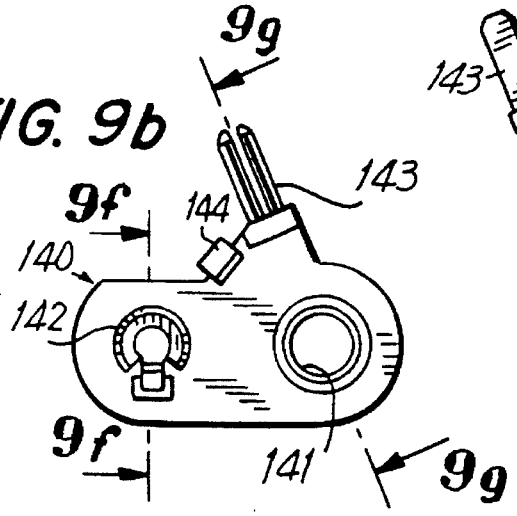
FIG. 9*b* is a right side elevational view of the arm illustrated in FIG. 9*a;*
Figure 9F:
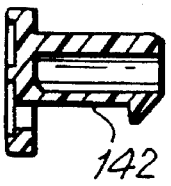
FIG. 9*f* is a cross-sectional view taken along lines 9*f*—9*f* of FIG. 9*b;*
Figure 9C:
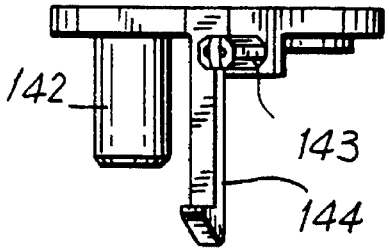
FIG. 9*c* is a top plan view of the arm illustrated in FIG. 9*c;*

FIGS. 7 and 8 further illustrate that feed roller shaft 31 is supported by a hole 131 in left side frame portion 130 and feed roller shaft 16 is supported in a hole 132 in left side frame portion 130. Shaft 133 rotatably supports sun gear 13 and arm 140 mounted thereon.

FIGS. 9*a*–9*g* further illustrate the construction and arrangement of arm 140.

Arm 140 includes a hole 141 for rotatably receiving shaft 133, and a shaft 142 for rotatably receiving planetary gear 14 (FIG. 6). Shaft 133 rotatably receives sun gear 13. A support member 143 engages one end of a spring member 150 (see FIG. 6). Support member 143 may take the form of a pin having a slit 143*a*.

Figure 10A:
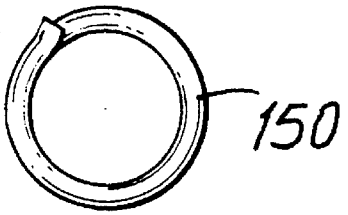
FIG. 10*a* is a top plan view of a spring member used in the printer.
Figure 10B:
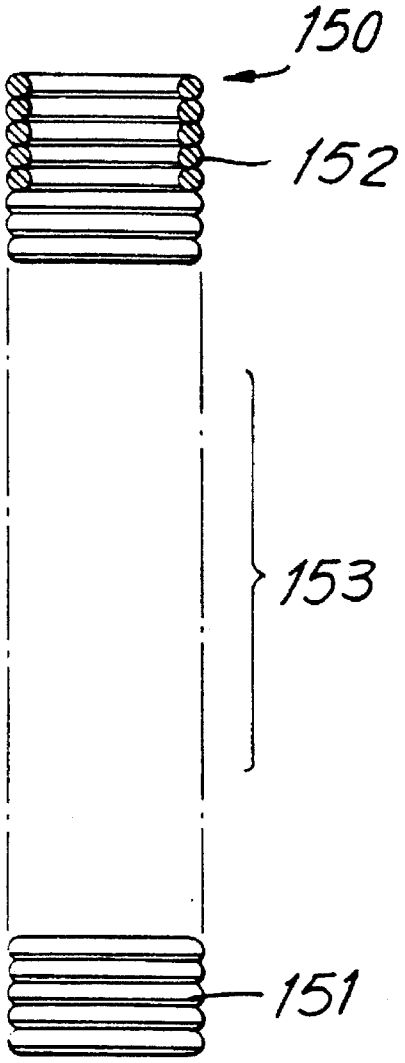
FIG. 10*b* is a side view, partly in cross-section, of the spring member of FIG. 10*a;*

FIG. 10 more clearly illustrates spring member 150. Spring member 150 is similar to a bar-like coiled spring. A lower end portion 151 of spring member 150 is coupled to support member 143 of arm 140 as shown in FIG. 6. An upper end portion 152 of spring member 150 is arranged so that it may contact a resisting portion 135 formed in a depressed portion 134 of left side frame 130. An intermediate portion 153 of spring member 150 is supported by two hold pieces 136, 136 of left side frame 130. In the normal position of spring 150, arm 140 is held in a position such that planetary gear 14 does not engage feed-in gear 15.

Further, FIGS. 9a–9g illustrate a stopper 144 formed integrally with arm 140. Stopper 144 is inserted into an arcuate hole 137 (FIG. 7) formed in left side frame 130. In this arrangement, arm 140 can rotate within the range of arcuate hole 137. However, arm 140 is usually forced into the position shown in FIG. 6 by the force of spring member 150.

Figure 11:
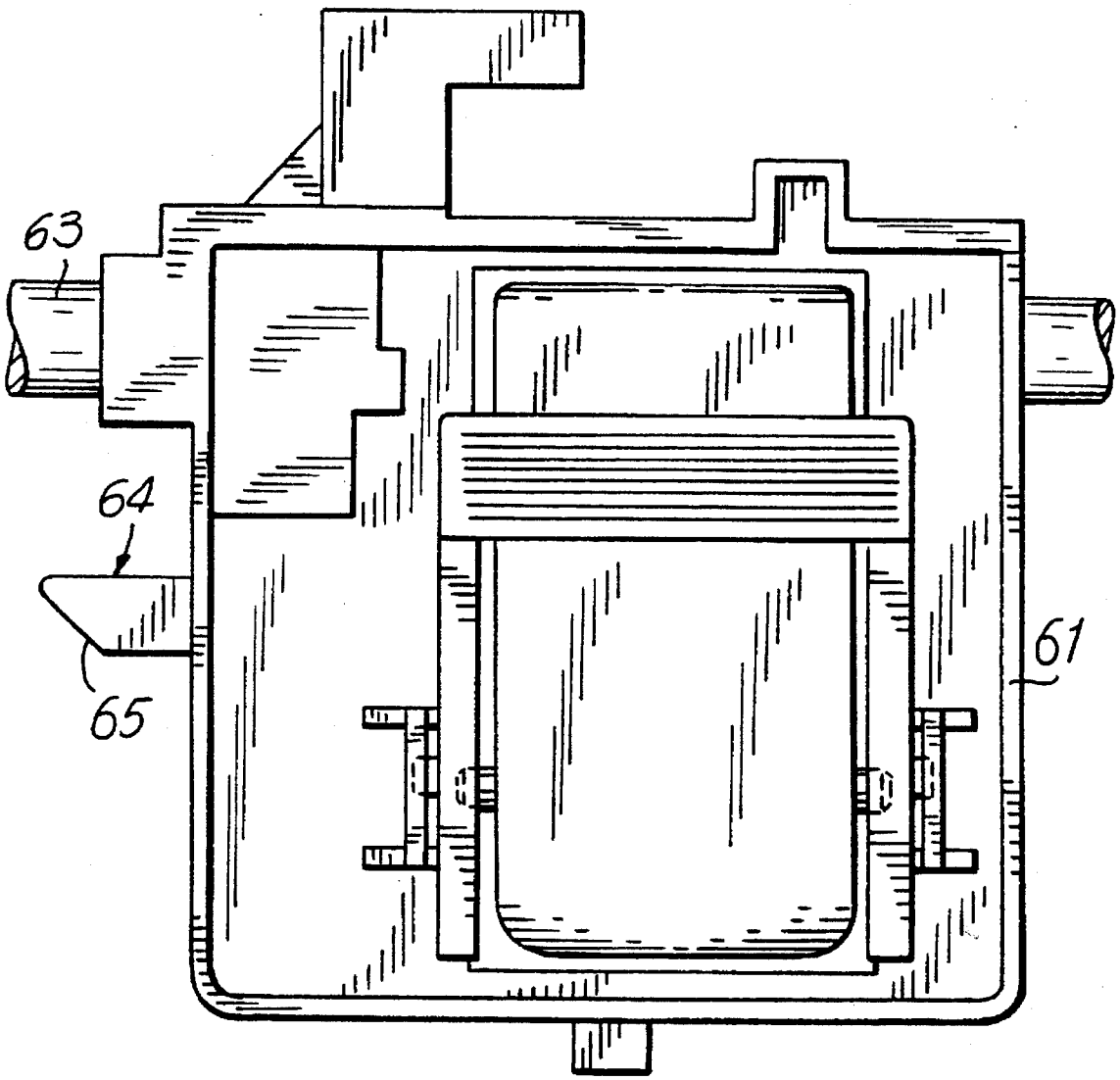
FIG. 11 is a top plan view of a carriage used in the printer in accordance with the invention.

FIG. 11 is a plan view of carriage 61. An operating member 64 is located on the left side wall of carriage 61 as depicted in FIG. 11. A distal end of operating member 64 is tapered to form a taper face 65. When carriage 61 is in a paper feed position adjacent left side frame 130, operating member 64 passes through arcuate hole 137' and a space 138 between hold pieces 136 and 136 (See FIGS. 6–8, 12), and contacts and displaces intermediate portion 153 of spring member 150 to the right as viewed in FIG. 12. This results in arm 140 rotating clockwise so that planetary gear 14 engages feed gear 15.

Figure 12:
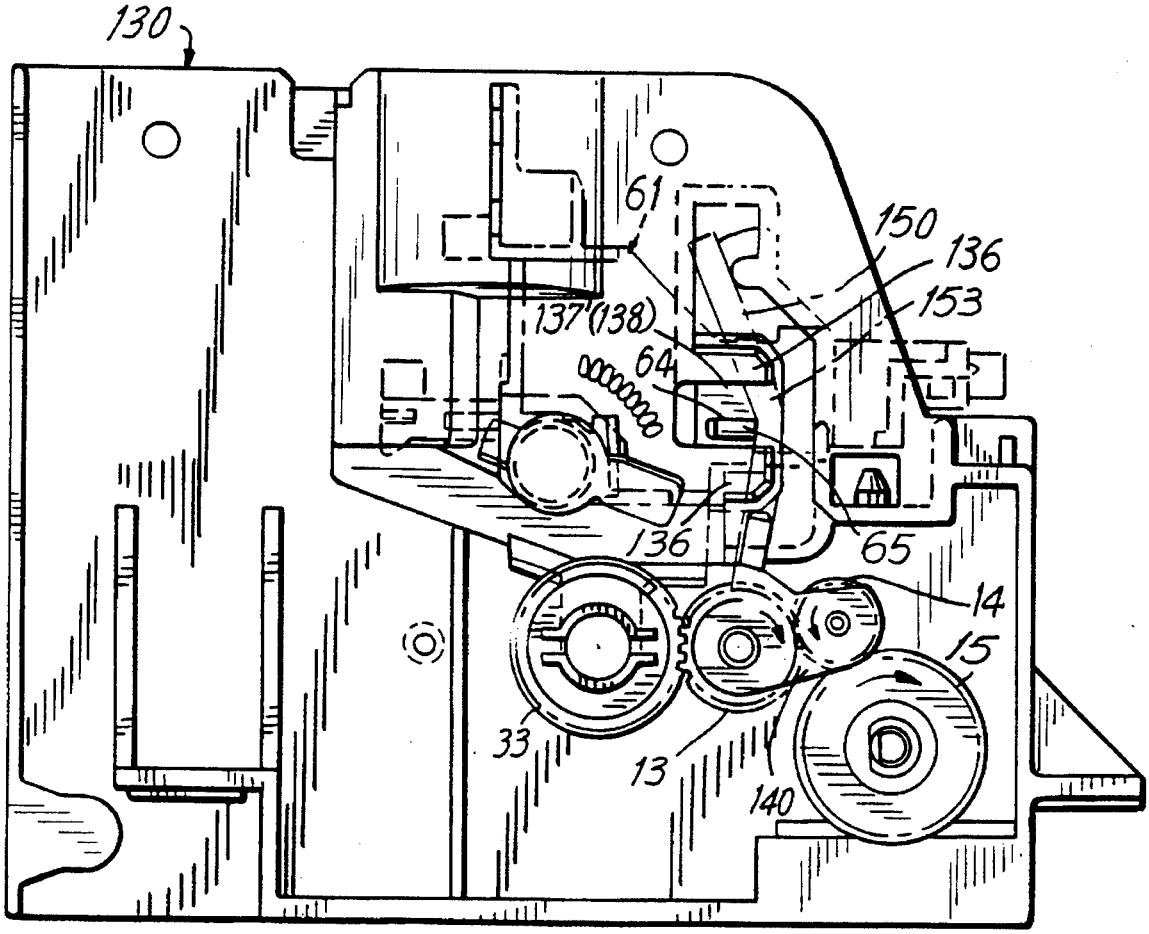
FIG. 12 is an enlarged side elevational view of a portion of the printer in accordance with the first embodiment of the present invention.

FIG. 12 illustrates the resulting operation when operating member 64 pushes against spring member 150 causing planetary gear 14 to engage feed gear 15. Because spring member 150 is a bar-like coiled spring, the contact between taper face 65 of the distal end of operative member 64 and intermediate portion 153 is smooth. Space 138 between and behind hold pieces 136, 136 permits intermediate portion 153 of spring member 150 to deform in space 138 to the left as viewed in FIG. 12. Spring member 150 is restricted in the direction normal to left side frame 130 as viewed in FIG. 12 by hold pieces 136, 136.

In other words, the resilient force of spring member 150 is utilized for engaging planetary gear 14 with feed gear 15. Therefore, a smooth meshing operation is ensured. Since sun gear 13 rotates in the direction to engage planetary gear 14 with feed gear 15, the meshing state of these gears is maintained unless the force applied by operating member 64 upon intermediate portion 153 or spring member 150 is removed.

Figure 13:
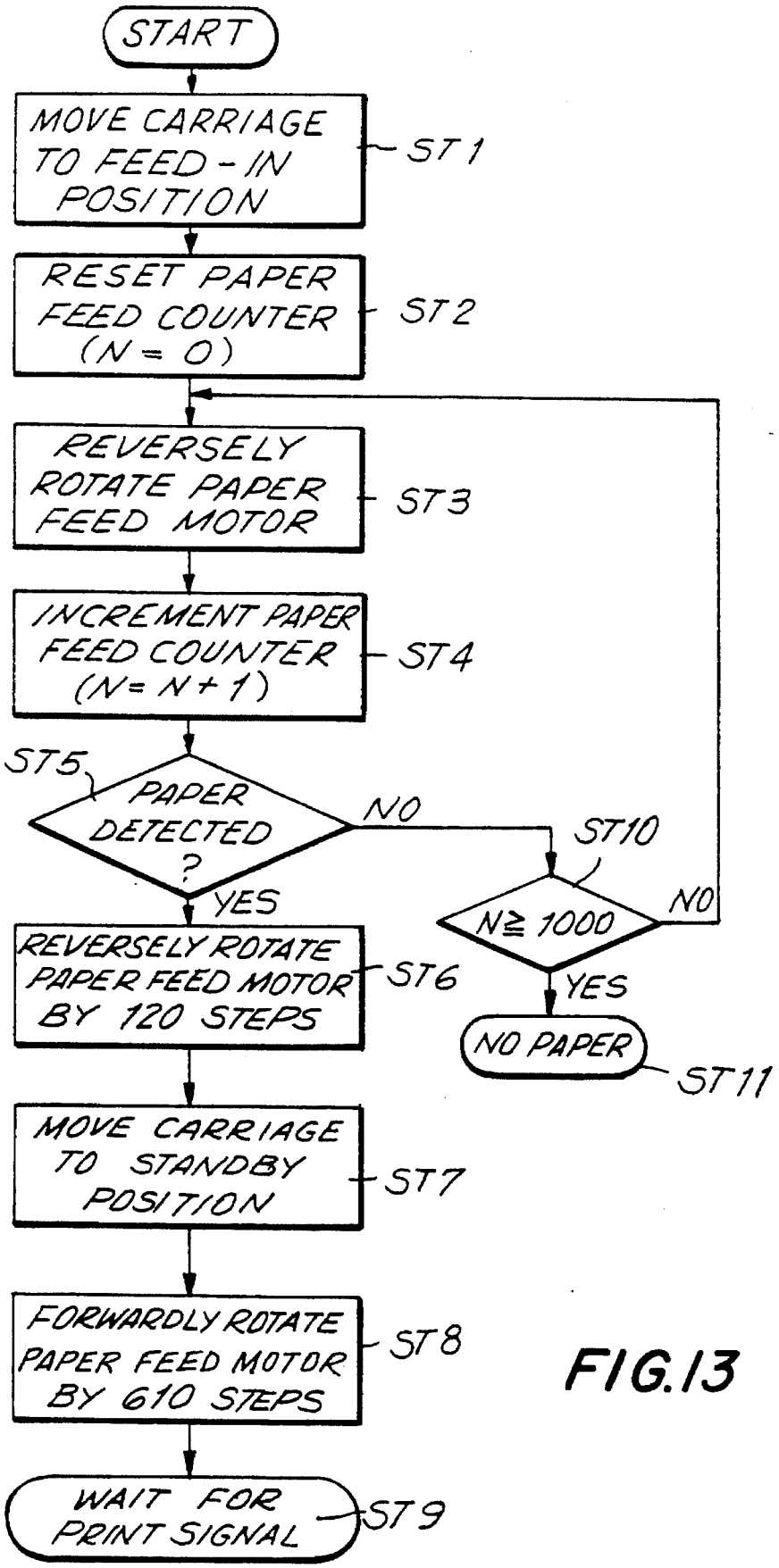
FIG. 13 is a block diagram explaining the operation of the carriage.

The operation of carriage 61 will now be described with reference to the block diagram of FIG. 13.

When a paper feed signal is inputted from a computer (for example) to the printer, carriage 61 is moved to the paper feed position as indicated in step ST1. When carriage 61 reaches the paper feed position, operating member 64 engages and displaces intermediate portion 153 of spring member 150. Arm 140 then rotates clockwise as shown in FIG. 12 to cause the engagement of planetary gear 14 with feed gear 15.

In step ST2, a paper feed counter N (counting the number of steps defining the rotary displacement of paper feed motor M) is reset by setting counter N to zero.

In a step ST3, paper feed motor M is rotated in the reverse direction, and in a step ST4, paper feed counter N increases in increments of 1 (N=N+1).

When paper feed motor M rotates in the reverse direction, paper feed rollers 30 and gear 33 rotate in a counterclockwise direction. This counterclockwise rotation, as shown in FIG. 12, is transmitted to feed gear 15 through sun gear 13 and planetary gear 14. Paper feed roller 12, therefore, rotates in a clockwise direction to feed paper P into the feed path, as further indicated by arrow a in FIG. 5. Paper P, in a curved state, is guided by paper guide 42 to turn first lever 21 for detecting the paper to activate paper detect switch 23 (see FIG. 2).

In step ST5, a control system (not shown) determines whether or not the paper has actually been fed using the signal detected from paper detect switch 23.

In this decision step, if it is determined that paper P has been fed, the control system rotates paper feed motor M in a reverse direction by a predetermined amount of rotation (120 steps in this example), step ST6. By reversing paper feed motor M, paper P is further moved in the forward conveying direction by the forward, clockwise rotation of paper feed roller 12. Leading edge Pa of paper P contacts contact portion 41 (FIG. 5) between gate rollers 40 and paper feed rollers 30 which are rotating in the direction opposite to paper feed direction. In this way, when a corner of paper P contacts paper feed rollers 30 and gate rollers 40, paper P cannot be fed in the forward direction since rollers 30 and 40 are rotating in the reverse direction. Therefore, paper P, being fed by paper feed roller 12, will continue to swing about central part Pc until the entire leading edge Pa is flush against paper feed rollers 30 and gate rollers 40.

Furthermore, because paper feed rollers 30 and gate rollers 40 are rotating in the opposite direction to the paper feed direction, leading edge Pa of paper P will never enter the nip between paper feed rollers 30 and gate rollers 40. This will ensure a smooth rotation of the paper and, therefore, a smooth deskewing operation.

When leading edge Pa of the paper does contact contact portion 41, the paper P has begun curving and follows the shape of a paper guide 42, as shown in FIG. 5. The force generated when paper P contacts contact portion 41 acts on paper P to cause the paper's rotation (in the direction of arrow X in FIG. 4) about central part Pc of paper feed roller 12. Thus, a sure paper turn, or a sure skew removal, is secured.

In step ST7, carriage 61 is positioned to the print stand-by position (where operating member 64 is disengaged from spring member 150).

This movement of the carriage causes operating member 64 to disengage from spring member 150. Spring member 150 is restored to its original shape as viewed in FIG. 6. Arm 140 rotates counterclockwise to its original position (FIG. 6), and planetary gear 14 disengages from feed gear 15.

In step ST8, paper feed motor M is then rotated in the forward direction by a predetermined number of turns (610 steps, by way of example).

Figure 15:
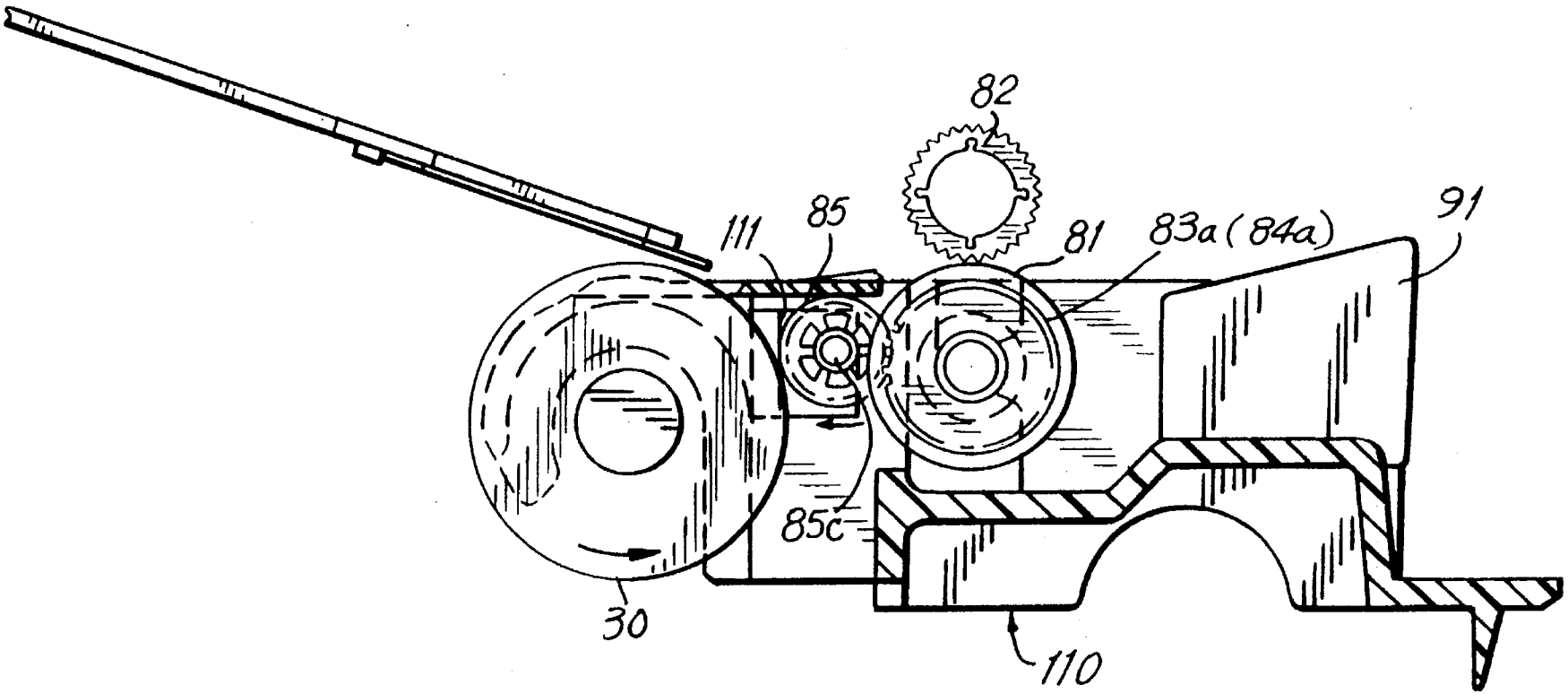
FIG. 15 is a partially enlarged cross-sectional view of the transport section of the printer in which the paper feed rollers rotate in a direction opposite to the paper feed direction.

By rotating paper feed motor M forward, paper feed rollers 30 also rotate in the paper conveying direction as viewed in FIG. 15. The paper is pulled into the nip of paper feed rollers 30 and pinch rollers 50, and advances past pinch rollers 50. Leading edge Pa of the paper reaches print section 60, and the print-ready state is achieved.

In step ST9, the carriage is oriented for printing. A print signal is received and a carriage motor, not shown, is driven by the print signal. Carriage 61 reciprocates. During the reciprocative motion of the carriage, ink jet head 62 emits "dots" of ink, thereby performing the printing operation. The paper on which ink is printed is discharged through transport section 80, which includes transport rollers 81 and notched transport rollers 82. The paper then travels through exit section 90, which includes push-up means 91, which pushes the paper up along both sides thereof, and notched roller 92 which pushes the central part of the paper down. Thereafter, paper P is discharged onto discharged paper tray 100 (see generally FIG. 2).

However, if the control system determines that no paper has been fed (decision branch of ST5), the control system, by monitoring counter N, determines whether or not the number of steps of paper feed motor M, when it has been rotating in the reverse direction (the number of steps N counted in step ST4), has reached 1000 (ST10).

If the counter has reached 1000 (ST11), the control system decides that automatic feed device 10 is empty and displays a "No paper" indication in a display window (not shown).

If the counter has not reached 1000, the control system repeats the procedural sequence subsequent to step ST3.

The printer constructed, arranged and operated in accordance with the above-described operation has the following advantages.

First, paper P rotates easily about paper feed roller 12. This is in part due to paper feed roller 12 being a thin, single roller. Also, paper feed roller 12 presses upon only central part Pc of the paper as viewed in the paper width direction. Paper P easily rotates about this press-contact part (central part Pc) in the direction of arrow X (FIG. 4), thereby securing a reliable removal of any paper skew.

Second, it is not necessary to form a slack loop in the paper between paper feed roller 12 and contact portion 41. Accordingly, the distance required between paper feed roller 12 and contact portion 41 is smaller than that in conventional printers. In addition, no space is required to form the slack loop as required in conventional apparatuses. The result is an overall reduction in paper feed time and printer size.

Third, between paper feed roller 12 and contact portion 41, paper guide 42 is provided to guide the paper to contact portion 41 in a curved state and will support the outside of the curved portion of the paper. The action of the paper to curve toward the outside of the curved portion is limited by paper guide 42. The force generated when paper P contacts contact portion 41 assists in causing the paper P to rotate about central part Pc of paper feed roller 12. This secures a smooth and reliable paper rotation and ensures a reliable, smooth skew removal.

Fourth, when paper feed roller 12 is rotating in the paper feed direction, paper feed rollers 30 and gate rollers 40 rotate in a direction opposite to the paper feed direction. This way leading edge Pa of the paper will not enter the nip between paper feed rollers 30 and gate rollers 40, ensuring a smooth rotation of the paper.

Fifth, since any skew is removed by bringing the paper into contact with contact portion 41 between paper feed rollers 30 and gate rollers 40, the paper can be transported immediately after the skew of the paper is removed.

Lastly, the construction of the automatic paper feeder allows for the distance between paper feed roller 12 and contact portion 41 to be shorter than that required when a separate automatic paper feeder is coupled with the printer.

Figure 14:
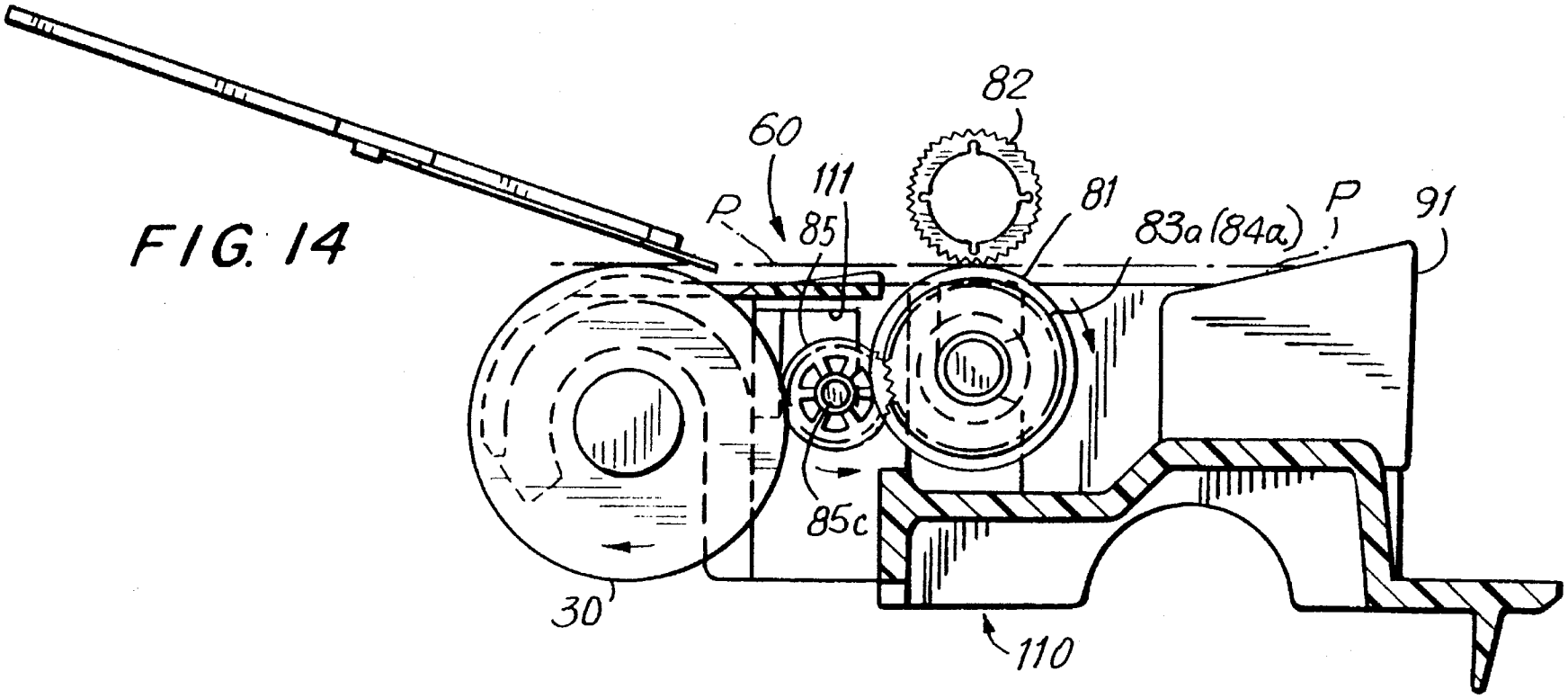
FIG. 14 is a partially enlarged cross-sectional view of the transport section of the printer in which the paper feed rollers rotate in the paper feed direction.

The drive mechanism for transport section 80 will now be described with reference to FIGS. 4, 14 and 15. Transport section 80 includes six transport rollers 81 which are respectively aligned with six notched transport rollers 82.

Three transport rollers of the six transport rollers 81 are secured to a rotation shaft 83, and the remaining three transport rollers 81 are secured to another rotation shaft 84. Shafts 83 and 84 are supported by intermediate frame 110. Of the three paper feed rollers 30, the rollers on both sides are coupled through transmission gears, generally indicated at 85, and rotate gears 83*a* and 84*a*, which are secured to rotation shafts 83 and 84, respectively. There are two transmission gears. Each transmission gear 85 rotates each shaft 83 and 84, respectively.

Each transmission gear 85 includes a gear part 85*a*, which engages gear 83*a* or 84*a*, respectively, and is secured to rotation shaft 83 or 84, respectively. Each transmission gear also includes a common shaft 85*c* and a roller part 85*b* which engage feed roller 30. Both ends of the common shaft 85*c* are movably supported in a rectangular hole 111 formed in intermediate frame 110 (FIG. 14).

With such a construction and arrangement, transmission gear 85 functions as a one-way clutch. As illustrated in FIG. 14, when paper feed rollers 30 rotate in the paper feed direction, transmission gears 85 move downward (in the engaging direction) along rectangular hole 111, and transmit the power of paper feed rollers 30 to transport rollers 81. However, as shown in FIG. 15, when paper feed rollers 30 are rotated in the direction opposite to the paper feed direction, transmission gears 85 move upward (in the escape direction) along rectangular hole 111, and do not transmit the power of paper feed rollers 30 to transport rollers 81. Thus, transport rollers 81 rotate only when paper feed rollers 30 rotate in the paper feed direction, and do not rotate when paper feed rollers 30 are rotated in the reverse direction.

As shown in FIGS. 3 and 4, two notched transport rollers 82 are secured to each end of each of the three shaft members 86. A spring, not shown, forces the center of each shaft member 86 toward transport rollers 81. Notched transport rollers 82 are driven and rotate by engagement with transport rollers 81. The diameters or the number of teeth of paper feed rollers 30, transmission gears 85, and transport rollers 81 are all selected so the peripheral speed of transport rollers 81 is about 12% faster than the peripheral speed of paper feed rollers 30. Accordingly, paper P, as shown in FIG. 14, is printed upon in print section 60 in a state that it is floating while at least essentially simultaneously being pulled by transport rollers 81 and notched transport rollers 82 thereby keeping the paper taut.

A printer using a skew removal apparatus in accordance with a second embodiment of the present invention will now be described with particular reference to FIGS. 16 and 17.

A primary difference between the printer in accordance with a second embodiment and that of a printer in accordance with a first embodiment of the present invention is that during the paper skew removal operation in accordance with the second embodiment, the paper supply rollers are rotating in the paper feed direction and paper feed rollers 241 and gate rollers 245 are not rotating.

The difference of those printers and others will be described in detail in connection with FIGS. 16 and 17.

Figure 17:
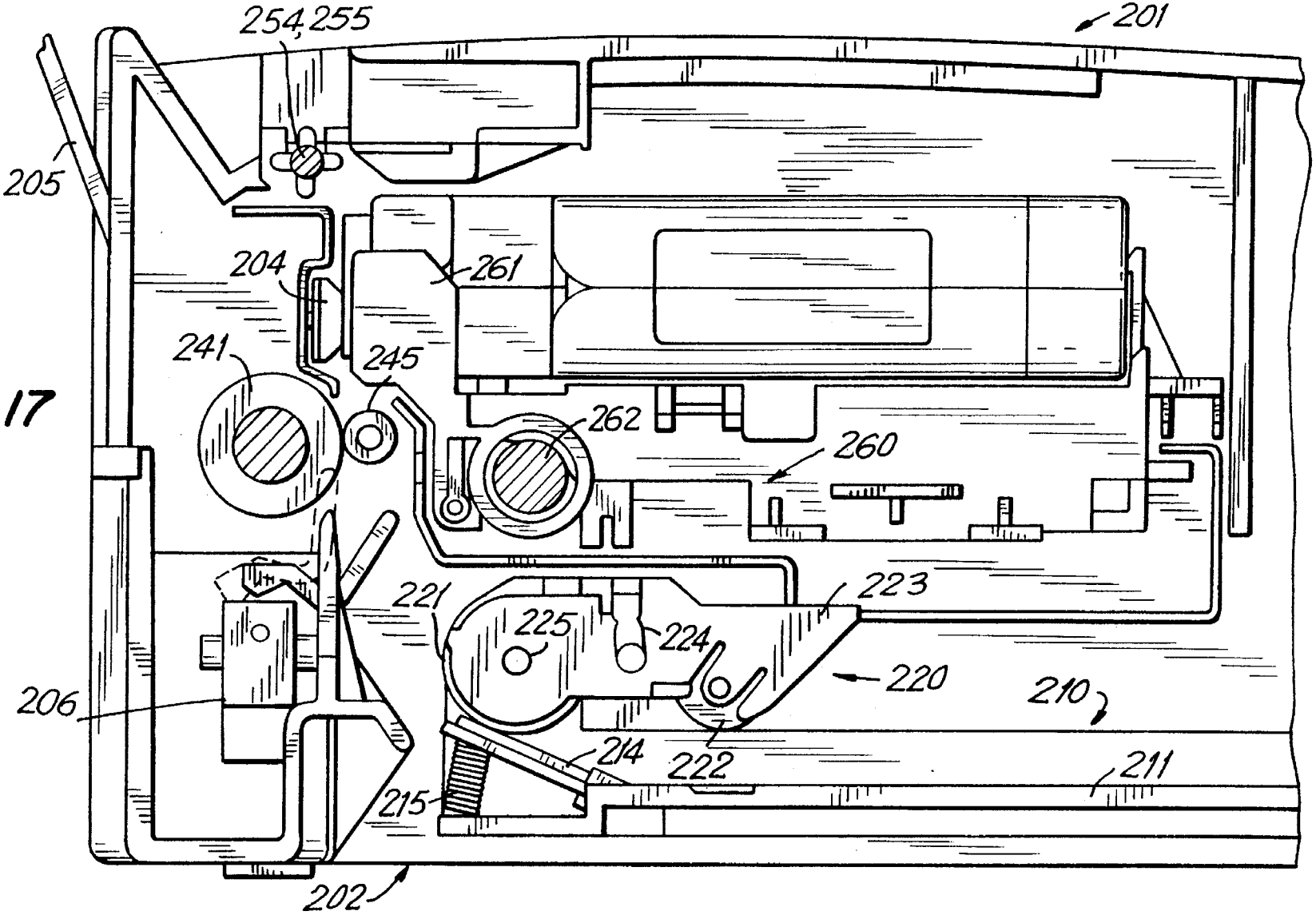
FIG. 17 is an enlarged side elevational view, partly cut away, of the printer of FIG. 16.

A printer body in accordance with the invention, generally indicated at 201 in FIG. 17, may be aligned horizontally or vertically. By way of example, the printer illustrated in FIG. 17 is set horizontally with a manual inserter port 202 facing down. In this orientation, paper cannot be manually fed through inserter port 202. To use inserter .port 202, the printer must be set vertically while the paper supply tray 210 is closed.

Figure 16:
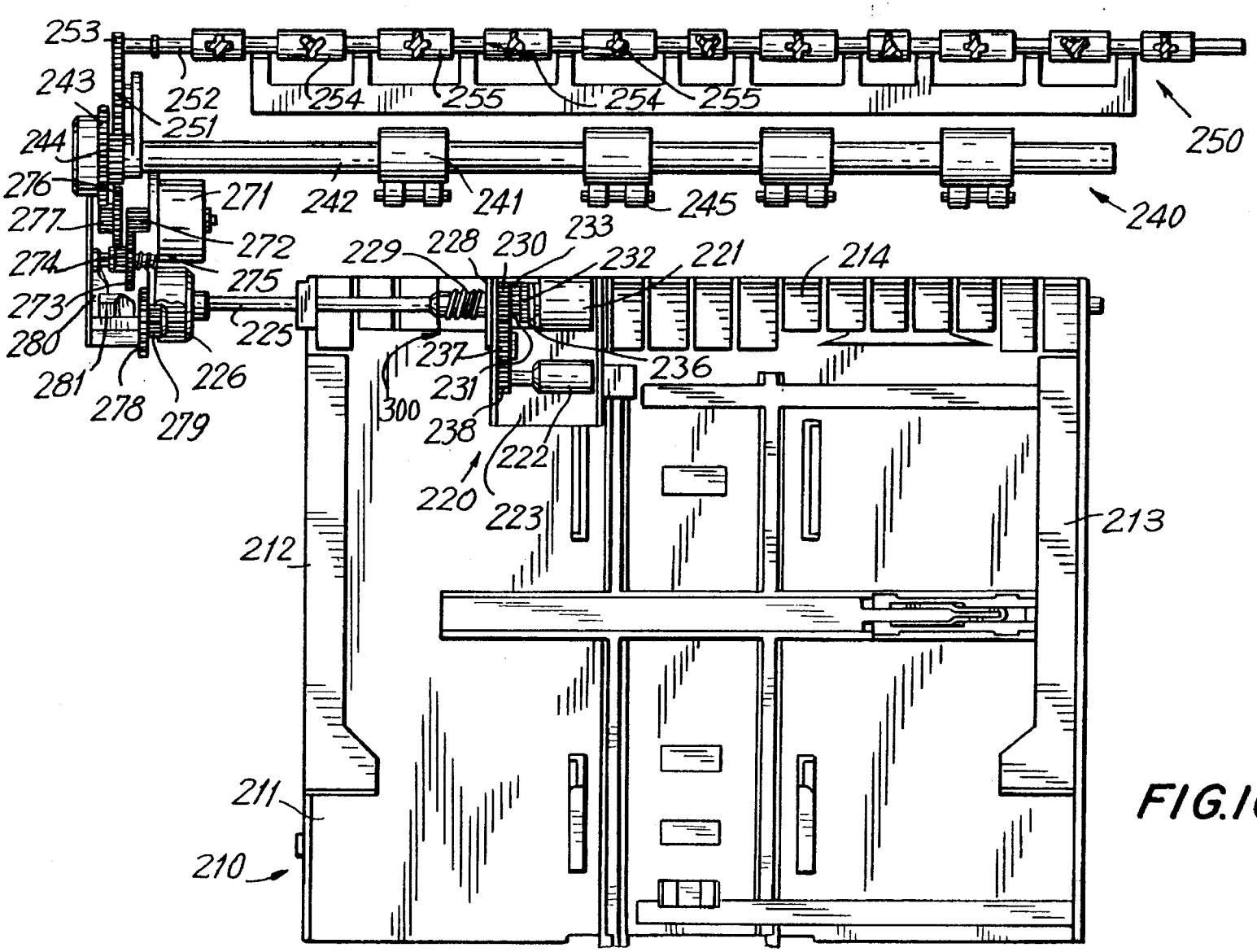
FIG. 16 is a developed plan view of a portion of the printer in accordance with a second embodiment of the present invention.

Printer body 201 includes a paper supply tray, generally indicated at 210, a paper supply roller unit, generally indicated at 220, a paper feed roller unit, generally indicated at 240, a discharge roller unit, generally indicated at 250, and a driveforce transmission switch unit 270 (FIG. 16). Paper supply tray 210 can have thereon a stack of individual papers P. Paper supply roller unit 220 contacts the central part (as viewed in the paper width direction) of the top sheet of paper P on the stack of paper in paper supply tray 210, and feeds the individual sheet forward, thereby separating it from the remaining stack of paper. Paper supply roller unit 220 repeats the operation of lifting up the next top sheet of paper and thereafter feeding it forward. Paper feed roller unit 240 includes a plurality of paper feed rollers 241 and a plurality of gate rollers 245. Paper feed rollers 241 and gate rollers 245 cease their rotation when the sheets of paper are fed, in order to first align the orientation of fed paper P. Discharge roller unit 250 operates in cooperation with paper feed roller unit 240 (FIG. 16) to discharge paper P into a stacker 205. This paper has passed a platen 204 having already undergone the printing operation. Drive force transmission switch unit 270, when triggered by a part of a carriage 260, switches the power transmission route between a route from a paper-feed motor 271 to paper supply roller unit 220 and another route from paper-feed motor 271 to paper feed roller unit 240.

A description of the tray and those units will now be given with particular reference to FIGS. 16 and 17.

In paper supply tray 210, a left edge guide 212 is provided on the left side of a tray body 211. A right edge guide 213, provided on the right side, can slide laterally with respect to the paper feeding direction in accordance with the size of paper used. Thus, paper supply tray 210 is constructed such that the right edge guide is slidable with respect to the left edge guide. A pad holder 214, located on the front side of tray body 211, is forced upward by means of a spring 215 and brings the leading edge of the paper P into contact with the circumferential surface of paper supply roller 221.

Paper supply roller unit 220 includes a paper supply roller 221 which contacts only the central part of paper P, (as viewed in the paper width direction) and feeds the paper forward by a friction force generated between paper supply roller 221 and paper P. Paper supply roller 220 also includes a pull-out roller 222 located upstream of the paper supply roller 221 as viewed in the paper feed direction. These rollers, which are arrayed to have a length several tens percent of the paper width, are assembled into a roller guide holder 223, which rotates about a paper-supply roller shaft 225.

A roller gear 230 transmits a rotation force in the paper feed direction to both rollers 221 and 222. Roller gear 230, which abuts paper supply roller 221 within roller guide holder 223, is directly coupled to paper-supply roller shaft 225 through a torque limiter, generally indicated at 300, which is formed of a friction plate 228 and a spring 229 biasing the friction plate.

Figure 18A:
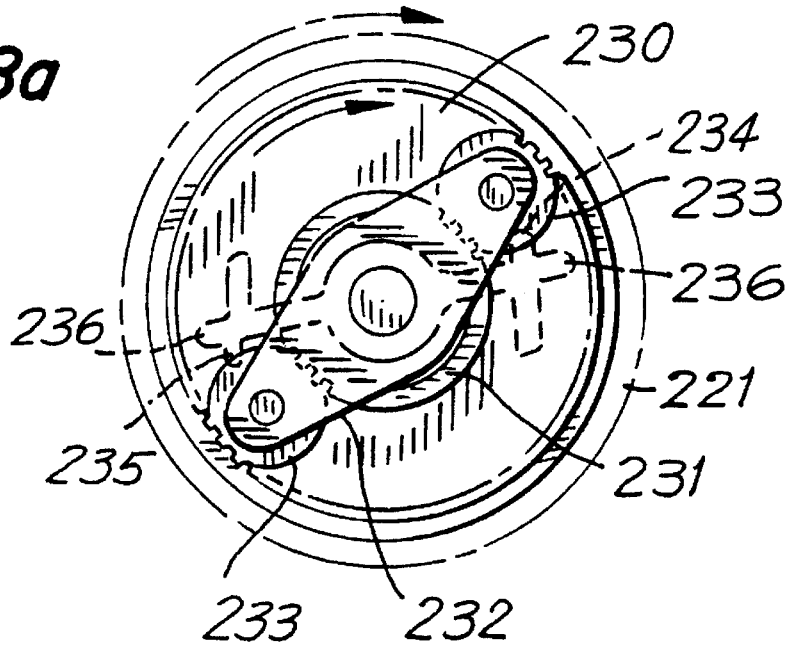
FIGS. 18*a* and 18*b* are plan views of a rotation transmission mechanism provided in a paper supply unit of the printer of FIG. 16.
Figure 18B:
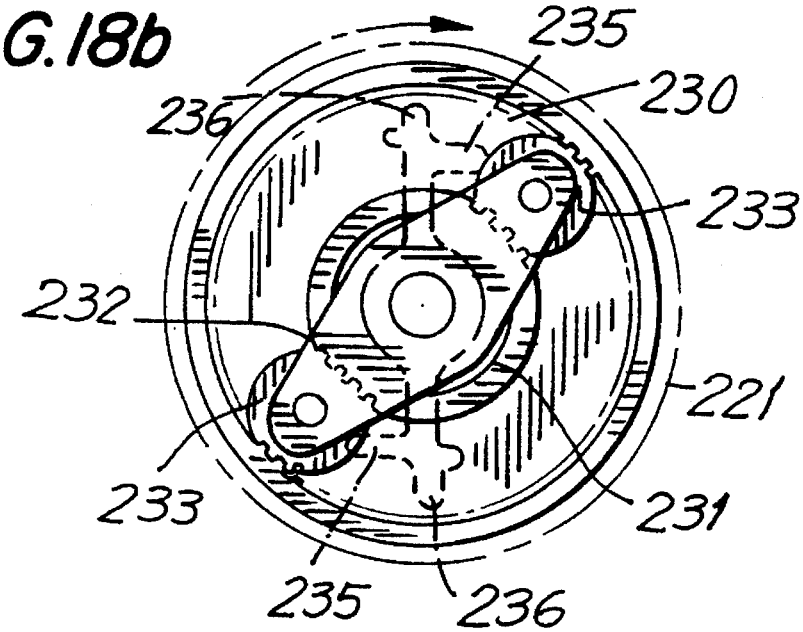

Two planetary gears 233, 233, as shown in FIG. 18, are rotatably mounted on a planetary lever 232 which rotates about paper-supply roller shaft 225 (FIG. 17). The two planetary gears 233 engage a pinion 231 which is integral with roller gear 230. Paper supply roller 221 includes a pawl 234 which stops the rotation of planetary gears 233 when roller gear 230 rotates, and contacts planetary lever 232 to allow the overrunning of planetary gears 233 when roller gear 230 stops. Paper supply roller 221 further includes a rack 236 for pushing planetary lever 232. When paper-supply roller shaft 225 receives a rotational drive force, as shown in FIG. 18(*a*), pawl 234 of rack 236 checks the rotation of planetary gears 233, so the rotation drive force from roller gear 230 is transmitted to paper supply roller 221. When the rotational drive force to paper-supply roller shaft 225 is interrupted, rack 236 pushes planetary lever 232, allowing planetary gears 233 to rotate- around pinion 231. In this way, paper supply roller 221 is rotatable in the paper feed direction, independently of the other rollers.

Roller gear 230 engages with and disengages from a pull-out gear 238 through an intermediate gear 237. Intermediate gear 237 is slidably supported in an elongated hole 224 of roller guide holder 223. Pull-out gear 238 is integral with pull-out roller 222. When paper-supply roller shaft 225 receives a rotation drive force, roller gear 230 transmits a rotation force in the paper feed direction and engages intermediate gear 237. When paper-supply roller shaft 225 stops rotating, roller gear 230 separates intermediate gear 237 from pull-out gear 238, thereby allowing pull-out roller 222 to rotate in the paper feed direction independently.

Paper feed roller unit 240 includes paper feed rollers 241 and gate rollers 245. Paper feed rollers 241 are mounted and affixed around paper-feed roller shaft 242. Paper-feed roller shaft 242 is driven by paper-feed motor 271, through a drive-force transmission switch unit 270, which will be described below.

Discharge roller unit 250 is located downstream of paper feed roller unit 240, while platen 204 is disposed therebetween. Discharge roller unit 250 engages paper feed rollers 241 through pinion 244. Pinion 244 is integral with paper feed gear 243. Therefore, discharge roller unit 250 rotates with paper feed rollers 241. Further, a shaft 252 has a paper discharge gear 253 integral with shaft 252 and at one end thereof. Paper discharge gear 253 engages intermediate gear 251. Shaft 252 and paper discharge gear 253 are made of a resin material. In order to eliminate burr removal steps, each paper discharge roller 254 has a cross-sectional cross shape and each paper discharge roller 255 has a cross-sectional trifurcated shape. Each paper discharge roller 254 and 255 is alternately arrayed along shaft 252 (FIG. 16). During operation, the ridges of rollers 254 and 255 alternately contact the surface of the sheets of papers fed in. For the cross-sectional shapes of those rollers 254 and 255, the mold division and mold release used to form the rollers are easy. The cross-sections of those rollers may be properly shaped in other configurations, provided these configurations have ridges alternately coming in contact with the paper surface. For example, square or turtleback shapes are allowed.

Drive-force transmission switch unit 270 switches the drive form transmission route between paper supply roller 221 and paper feed rollers 241. Drive-force transmission switch 270 is disposed in a "home" position, the switching operation being carried out by carriage 260.

Figure 19A:
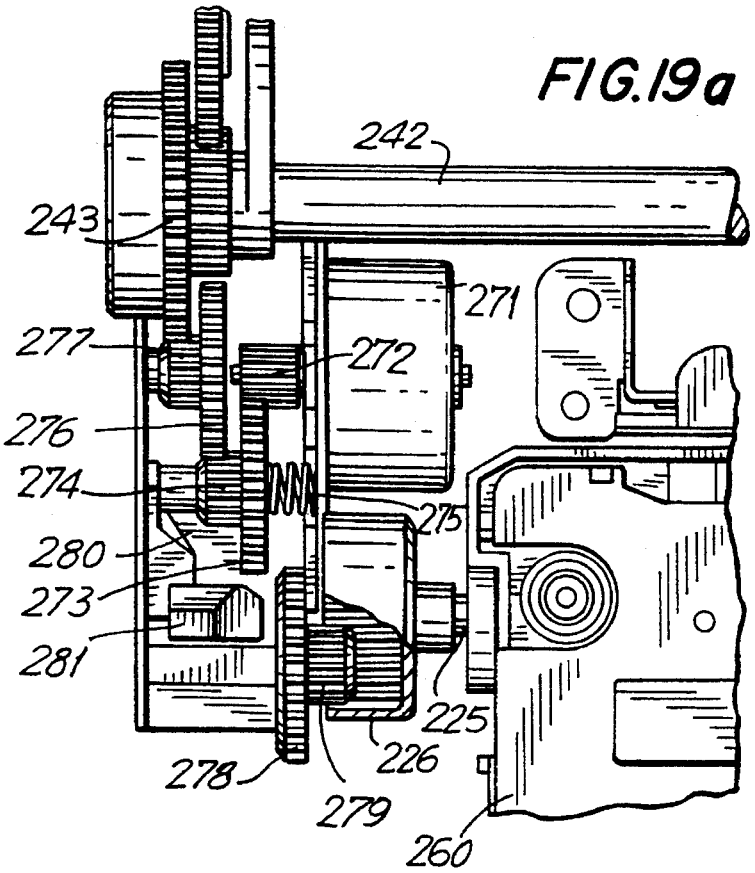
FIGS. 19*a* and 19*b* are side elevational views, partly in cross-section, of a rotation transmission switch unit used in the printer of FIG. 16.
Figure 19B:
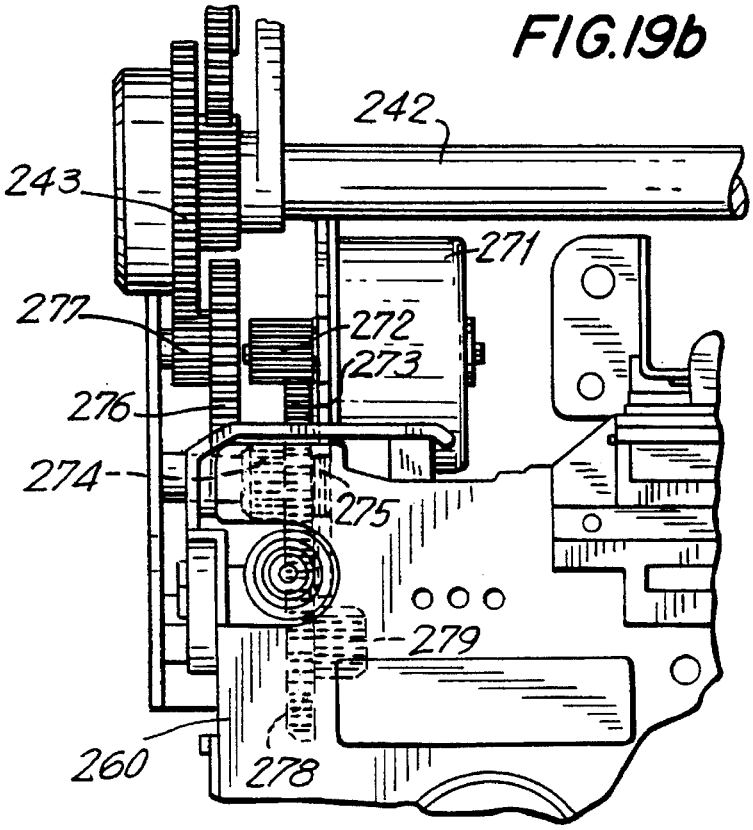
Figure 20A:
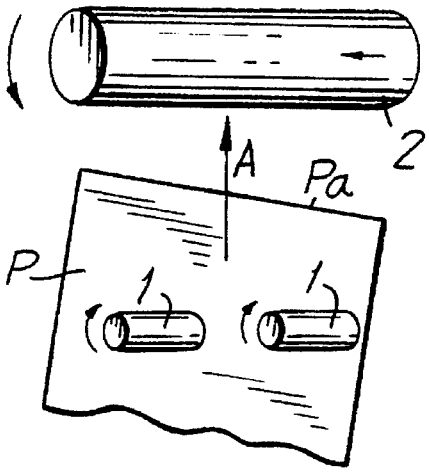
FIG.20a PRIOR ART
FIGS. 20*a*–20*c* are diagrammatic views showing the skew removal operation of a first conventional paper skew removal apparatus.
Figure 20B:
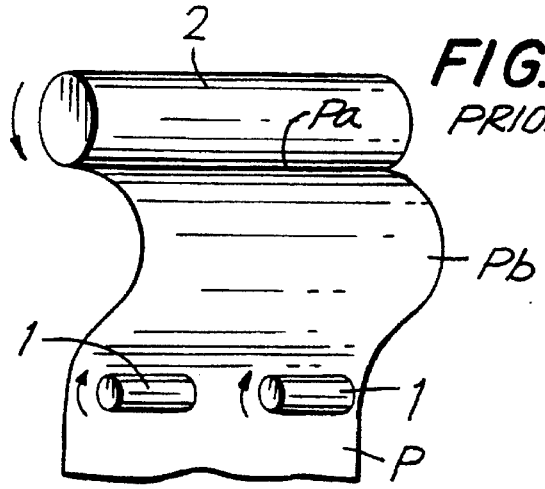
FIG.20b PRIOR ART
Figure 20C:
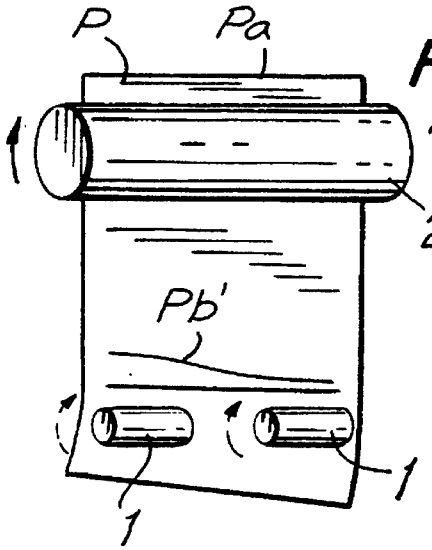
FIG.20c PRIOR ART
Figure 21A:
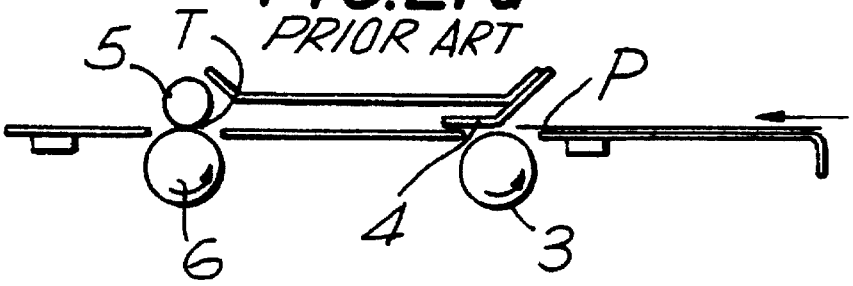
FIG. 21a PRIOR ART
FIGS. 21*a*–21*c* are diagrammatic views showing the construction and the skew removal operation of another conventional paper skew removal apparatus.
Figure 21B:
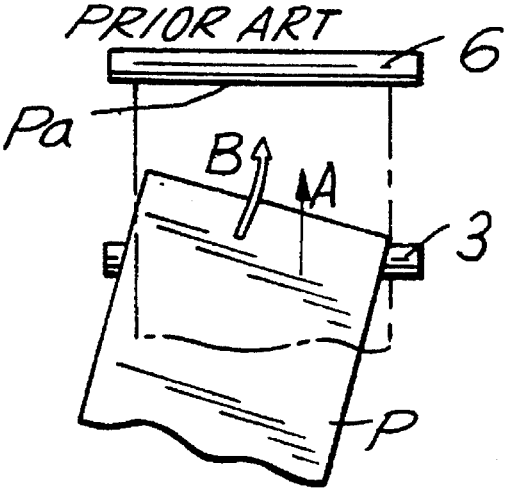
FIG. 21b PRIOR ART
Figure 21C:
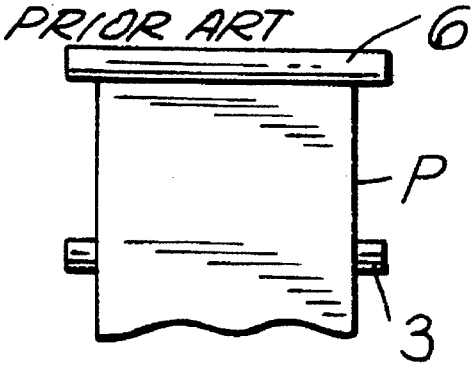
FIG. 21c PRIOR ART

A switch gear 273, engaged with pinion 272 of paper-feed motor 271, as shown in FIG. 19(*a*), is constantly biased to the left in the drawing by a spring 275. In this position, switch gear 273 causes a pinion 274, integral with switch gear 273, to engage a first intermediate gear 276. A pinion 277 is integral with first intermediate gear 276. Since paper feed gear 243 engages pinion 277, shaft 242 will rotate, thereby transmitting a rotational force to paper feed rollers 241. When switch gear 273 is in the position as illustrated in FIG. 19(*b*) and resisting the spring force of spring 275, switch gear 273 engages a second intermediate gear 278 and transmits a rotational force to paper supply roller 221 through a pinion 279 that engages an internally toothed gear 226.

A cam member 280 functions to move switch gear 273 to the right, resisting the spring force of spring 275. The other end 281 of cam member 280 protrudes into a space in which carriage 260 moves. When end 281 of cam member 280 contacts the part of carriage 260 moving toward the "home" position, it moves switch gear 273 to the right, as seen in FIG. 19(*b*).

FIG. 17 illustrates a paper sensor 206 that senses the leading edge of a sheet of paper fed to paper supply roller 221. A thermal recording head 261 is mounted on carriage 260. A guide bar 262 guides carriage 260 in the longitudinal direction of platen 204.

The printer constructed and arranged in accordance with the present invention will now be described.

FIG. 19(*b*) depicts carriage 260 in the ready-for-print mode at the "home" position of printer body 201.

In this position, a part of carriage 260 pushes end 281 of cam member 280 in the direction orthogonal to the plane of the paper, thereby rotating cam member 280. With the turn of the cam member, switch gear 273 is moved to the right (FIG. 19(*b*)) and engages second intermediate gear 278. Therefore, paper-feed motor 271 is operatively coupled to paper-supply roller shaft 225. This results because gear 226 is rotatably mounted on shaft 225, gear 226 engages pinion 279, and pinion 279 is integral with the second intermediate gear 278.

Therefore, if a paper supply command signal signals paper-feed motor 271, paper-feed motor 271 begins to operate. Paper supply roller 221, linked with paper-feed motor 271 by way of intermediate gear 237 and paper supply tray 210, is rotated. With this rotation of the rollers, the top sheet of paper in the paper stack contained in paper supply tray 210 is fed to paper feed roller unit 240.

When feeding the paper, paper supply roller 221 contacts only the central portion of the paper. Accordingly, any skew is removed from the paper according to the skew removal operation in accordance with the present invention disclosed with reference to FIG. 1. Torque limiter 300 is located between paper-supply roller shaft 225 and roller guide holder 223. And, since, there is no spring similar to spring 214 provided for pull-out roller 222, the pressing force applied by pull-out roller 222 upon the paper is small enough that the rotation of the paper is not hampered.

During the paper feeding operation, paper sensor 206, located just before the paper feed roller unit 240 detects the leading edge of the incoming paper P and sends a detect signal to a sequence controller (not shown) which in turn operates the carriage motor. Carriage 260 now begins to scan for the print operation.

As shown in FIG. 19(*a*), when carriage 260 begins to move to the right, as shown in the Figure, switch gear 273, which has been moved to the right by a part of the carriage through cam member 280, is returned to the left side by the spring action of spring 275 when switch gear 273 is released from being pushed by carriage 260. Switch gear 273 disengages from second intermediate gear 278. Pinion 274, integral therewith, is made to engage with the first intermediate gear 276. Paper feed rollers 241 are rotated by paper feed gear 243 which are engaged with and rotated by pinion 277. Accordingly, in cooperation with gate rollers 245 also rotating, the paper with the skew removed is fed to platen 204.

When the power transmission route is switched, shaft 252 begins to rotate when intermediate gear 251 begins to rotate. The edge portions of paper discharge rollers 254 and 255, having the difference cross-sectional shapes, alternately contact with the paper after it has passed the platen 204, and feed the paper toward the upper portion of stacker 205. The paper feeding operation is now complete.

In the embodiments disclosed above, the paper skew removal apparatus is applied to a printer. However, it is understood that it may be applied in copying machines and other general printing machines.

Furthermore, it is understood that while the skew removal operation in the embodiments is performed between the paper supply roller and the paper feed rollers, it may be performed between the paper supply roller and the platen roller.

It will thus be seen that the objects set forth above, among those made apparent from the preceding description, are efficiently attained and, since certain changes may be made in carrying out the above method and in the construction(s) set forth without departing from the spirit and scope of the invention, it is intended that all matter contained in the above description and shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. A paper skew removal apparatus comprising:

a single paper feed roller for feeding a sheet of paper, said paper feed roller having a width less than the width of said paper, said paper feed roller being positioned to contact a central part of the paper as viewed in the paper width direction;

a contact portion positioned to be contacted by a leading edge of said paper, said contact portion extending in a direction essentially orthogonal to the advancing direction of the paper fed by said paper feed roller;

an arcuate paper guide, said paper guide being shaped and positioned to force the paper into a curved shape, to guide the paper to said contact portion and to support the convex side of said paper, said paper guide being located between said paper feed roller and said contact portion:

a feeding gear for rotating said single paper feed roller; a rotatable lever and a movable gear supported rotatably by said rotatable lever, said movable gear positionable in at least one of a first position at which said movable gear engages with said feeding gear to rotate said single paper feed roller and a second position at which said movable gear does not engage with said feeding gear: and a spring member and a carriage, said carriage including an operating member that engages and displaces all intermediate portion of said spring member causing said lever to rotate toward said first position at which said movable gear engages said feeding gear.

2. The paper skew removal apparatus claimed in claim 1, wherein the width of said single paper feed roller is selected to be essentially equal to or less than one-third of the width of the narrowest sheet of paper with which the apparatus is designed to operate.

3. The paper skew removal apparatus claimed in claim 2, wherein the width of said single paper feed roller is selected to be essentially equal to or less than 10% of the width of the narrowest sheet of paper with which the apparatus is designed to operate.

4. The paper skew removal apparatus claimed in claim 1, wherein said paper guide is stationary during paper feed.

5. A printer comprising:

a single paper feed roller for feeding a sheet of paper, said paper feed roller having a width less than the width of said paper, and said paper feed roller being positioned to contact a central part of the paper as viewed in the paper width direction;

a contact portion positioned to be contacted by a leading edge of said paper, said contact portion extending in a direction orthogonal to the advancing direction of the paper fed by said paper feed roller;

a gate roller;

a second paper feed roller, said gate roller being engageable with said second paper feed roller, said contact portion being defined between said second paper feed roller and said gate roller;

an arcuate paper guide, said paper guide being shaped and positioned to force the paper into a curved shape, to guide the paper to said contact portion and to support the convex side of the paper, said paper guide being located between said single paper feed roller and said contact portion;

a feeding gear for rotating said single paper feed roller; a rotatable lever and a movable gear supported rotatably by said rotatable lever, said movable gear positionable in at least one of a first position at which said movable gear engages with said feeding gear to rotate said single paper feed roller and a second position at which said movable gear does not engage with said feeding gear; and a spring member and a carriage, said carriage including an operating member that engages and displaces an intermediate portion of said spring member causing said lever to rotate toward said first position at which said movable gear engages said feeding gear.

6. The printer claimed in claim 5, further including an automatic paper feeder that is assembled into the printer.

7. The printer claimed in claim 5, further including a drive mechanism operatively coupled to said single paper feed roller, said second paper feed roller and said gate roller so that when said single paper feed roller rotates in the paper feeding direction, said second paper feed roller and said gate roller rotate in an opposite direction so that paper cannot be fed between said second paper feed roller and said gate roller.

8. The printer claimed in claim 5, further including a drive mechanism operatively coupled to said single paper feed roller, said second paper feed roller and said gate roller so that when said single paper feed roller rotates, said second paper feed roller and said gate roller are essentially motionless.

9. The printer claimed in claim 5, wherein said spring member is formed of a bar-like coiled spring.

10. The printer claimed in claim 5, further including a switch gear and a switching mechanism for switching said switch gear from a first position at which said switch gear transmits a rotational force to said second paper feed roller to a second position at which said second paper feed roller is disengaged from said switch gear.

11. The printer as claimed in claim 5, wherein the width of said single paper feed roller is selected to be essentially equal to or less than one-third of the width of the narrowest sheet of paper with which the apparatus is designed to operate.

12. The printer as claimed in claim 11, wherein the width of said single paper feed roller is selected to be essentially equal to or less than 10% of the width of the narrowest sheet of paper with which the apparatus is designed to operate.

13. The printer, as claimed in claim 5, wherein said paper guide is stationary during paper feed.

14. A method of removing skew from a sheet of paper in a printer, comprising the steps of:

providing a printer including a carriage displaceable along a path, a single paper feed roller, a drive mechanism for said roller including a driving member displaceable between a first position at which said driving member is out of drivable coupling with said single paper feed roller and a second position at which said driving member is drivingly coupled to said single paper feed roller to rotate said single paper feed roller, and a spring member operatively coupled to said driving member to bias said driving member to its second position, said carriage including an operating member constructed and arranged to engage an intermediate portion of said spring member to cause the spring member to displace said driving member from its first to its second position against the bias of said spring member when said carriage is displaced along a portion of its path, a paper feed path along which paper is permitted to travel, said single paper feed roller having a width less than the width of said paper, and a contact portion for being contacted by a leading edge of said paper, said contact portion extending in a direction essentially orthogonal to the advancing direction of the paper fed by said single paper feed roller;

detecting a paper feed signal;

moving said carriage to a paper feed position;

displacing said carriage a sufficient distance along a portion of its path so that said operating member engages and displaces said intermediate portion of said spring member to cause the driving member to be displaced to its second position to cause the rotation of said single paper feed roller;

feeding said paper along a paper feed path a sufficient distance to contact said contact portion;

removing skew from the paper by rotating said paper about said single paper feed roller such that a leading edge of said paper is essentially orthogonal to said contact portion; and moving said carriage away from said paper feed position so as to disengage said single paper feed roller.

15. The method claimed in claim 14, including the steps of providing a second feed roller and a gate roller; and abutting the leading edge of said paper between said second feed roller and said gate roller during which time said second feed roller and said gate roller are rotating in a direction opposite to a paper feeding direction, so that said second feed roller and gate roller define said contact portion.

16. The method claimed in claim 14, including the steps of providing a second feed roller and a gate roller; and abutting the leading edge of said paper between said second feed roller and said gate roller during which time said second feed roller and said gate roller are essentially motionless, so that said second feed roller and gate roller define said contact portion.

17. The method claimed in claim 14, wherein the width of said single paper feed roller is selected to be essentially equal to or less than one-third of the width of the narrowest sheet of paper with which the printer is designed to operate.

18. The method claimed in claim 14, wherein the width of said single paper feed roller is selected to be essentially equal to or less than 10% of the width of the narrowest sheet of paper with which the printer is designed to operate.

* * * * *